US008646541B2

(12) United States Patent
Asao et al.

(10) Patent No.: US 8,646,541 B2
(45) Date of Patent: Feb. 11, 2014

(54) BEACH CLEANER

(75) Inventors: Kosuke Asao, Wako (JP); Jun Nakajima, Wako (JP); Tatsuo Masuda, Wako (JP); Yasuji Hashimoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 412 days.

(21) Appl. No.: 13/142,930

(22) PCT Filed: Jan. 28, 2010

(86) PCT No.: PCT/JP2010/000509

§ 371 (c)(1), (2), (4) Date: Jun. 30, 2011

(87) PCT Pub. No.: WO2010/087183

PCT Pub. Date: Aug. 5, 2010

(65) Prior Publication Data

US 2011/0266012 A1 Nov. 3, 2011

(30) Foreign Application Priority Data

Jan. 29, 2009 (JP) ..... 2009-018658

(51) Int. Cl.
*A01D 15/00* (2006.01)
*A01B 43/00* (2006.01)

(52) U.S. Cl.
USPC ..... 171/111; 171/63

(58) Field of Classification Search
USPC ..... 171/63, 108, 111, 126, 127, 134, 135, 171/140–144; 172/100, 122, 159, 240; 209/233, 235, 243, 255
See application file for complete search history.

(56) References Cited

U.S. PATENT DOCUMENTS

| | | | | |
|---|---|---|---|---|
| 3,596,717 | A * | 8/1971 | Knudsen | 171/63 |
| 4,014,390 | A * | 3/1977 | Teixeira | 171/124 |
| 4,482,019 | A * | 11/1984 | Murphy | 171/63 |
| 6,568,482 | B2 * | 5/2003 | Ohzeki et al. | 171/111 |
| 6,857,479 | B2 | 2/2005 | Ohzeki et al. | |
| 6,899,185 | B2 | 5/2005 | Yagisawa et al. | |
| 7,841,422 | B1 * | 11/2010 | Chavez et al. | 171/63 |
| 8,113,294 | B2 * | 2/2012 | Arai et al. | 171/111 |

FOREIGN PATENT DOCUMENTS

| | | | |
|---|---|---|---|
| JP | 11-172647 | A | 6/1999 |
| JP | 2002-178824 | A | 6/2002 |
| JP | 2002-356827 | A | 12/2002 |
| JP | 3090540 | U | 12/2002 |
| JP | 2003-041547 | A | 2/2003 |
| JP | 2008-025209 | A | 2/2008 |

* cited by examiner

*Primary Examiner* — Robert Pezzuto
(74) *Attorney, Agent, or Firm* — Carrier Blackman & Associates, P.C.; William D. Blackman; Fulchand P. Shende

(57) ABSTRACT

A beach cleaner having a frame constructed by longitudinal members and lateral members, a ski member that is attached to the front portion of the frame and comes into contact with the sand surface, a towed portion to be towed by a towing vehicle, a separating machine that is provided on a lower front portion of the frame to separate and scrape up trash from the sand, a trash withdrawing member for capturing on a mesh member trash which was scraped up upon the frame at the rear side of the separating machine and a wheel on the rear portion of the frame. Further, a driving force conversion/transmission mechanism is provide for supporting the trash withdrawing member so that he trash withdrawing member is swingable and converting rotational driving force of the wheel to vibrating force to vibrate the trash withdrawing member.

6 Claims, 16 Drawing Sheets

BEACH CLEANER

TECHNICAL FIELD

The present invention relates to a beach cleaner for collecting various kinds of trash strewn on a sand beach such as a seaside resort or the like.

BACKGROUND ART

Various trash such as fragments of fishnets, ropes, vinyl strings, paper scraps, wood offcuts, waste cans, bottles, plastic bottles, caps of plastic bottles, stub of cigarettes, etc. are strewn on a sand beach such as a seaside resort or the like. As a beach cleaner for collecting these kinds of trash is known a beach cleaner in which a frame is constructed by plural longitudinal members extending in a traveling direction and plural lateral members which extend in a width direction and are substantially perpendicular to the longitudinal members, ski members are arranged at the four corner portions of the frame concerned so as to come into contact with the sandy soil, a scraper is secured to the front portion of the frame, a trash withdrawing member constructed by a net member to a box-shaped frame which is opened forwardly and upwardly is provided to the rear portion of the frame, and the frame is towed by a towing vehicle to run on the sand soil under the state that the scraper bites into the sand soil, whereby relatively small trash can be scraped up together with sand and collected on the net member (for example, see Patent Document 1).

PRIOR ART

Patent Document

Patent Document 1: JP-A-2002-356827

SUMMARY OF THE INVENTION

Problem to be Solved by the Invention

However, the conventional beach cleaner comes into contact with the ground surface through the ski members, and thus little vibration is applied to the trash withdrawing member, so that sand scraped up onto the net member is not screened out and thus it remains on the net member in some cases. Furthermore, according to the conventional beach cleaner, the rear wall of the trash withdrawing member is provided vertically. Therefore, there is a case where trash and sand scraped up by the scraper impinge against the rear wall and then fall down along the rear wall, so that they are trapped as aggregate at the lower portion of the rear wall. In such a case, a worker drives a towing vehicle in a meandering motion to screen out the sand, or arbitrarily stops the towing vehicle to eliminate sand remaining on the trash withdrawing member.

Therefore, an object of the present invention is to solve the problem of the conventional technique described above, and provide a beach cleaner that can excellently screen out sand scraped up onto a trash withdrawing member with requiring neither a meandering motion nor an eliminating work.

Means of Solving the Problem

According to the present invention, a beach cleaner having a frame comprising longitudinal members and lateral members, a ski member that is secured to a front portion of the frame and comes into contact with the surface of a sand area, a towed portion to be towed by a towing vehicle, a separating machine that is provided to a front lower portion of the frame to separate and scrape up trash from the sand area, a trash withdrawing member that is provided at a rear side of the separating machine and captures, on a mesh member, the trash scraped up onto the frame at the rear side of the separating machine by the separating machine, and a wheel secured to a rear portion of the frame, is characterized by comprising a driving force conversion/transmission mechanism for supporting the trash withdrawing member so that the trash withdrawing member is swingable and converting rotational driving force of the wheel to vibration force to vibrate the trash withdrawing member.

According to the above construction, vibration is applied to the trash withdrawing member in connection with the rotation of the wheel, so that sand invading onto the mesh member can be screened out and prevented from staying on the mesh member.

In the beach cleaner described above, a sub frame may be secured to a pair of right and left frames so that the end portion thereof is swingable with the front end thereof being used as a fulcrum, and the trash withdrawing member may be secured to the sub frame.

According to this construction, when vibration is applied to the trash withdrawing member, the trash withdrawing member is vibrated with the front end of the sub frame being used as a fulcrum, so that sand invading onto the mesh member can be screened out and prevented from staying there.

In the above beach cleaner, the trash withdrawing member may be secured to the sub frame through a hinge at one side thereof in a right-and-left direction and through a detachable mooring hook at the other side thereof in the right-and-left direction, and the trash withdrawing member may be rotated sideways with the hinge being used as a fulcrum.

According to the above construction, when trash is withdrawn, the mooring hook is detached, and the trash withdrawing member is turned over sideways with the hinge being used as a fulcrum, whereby trash can be withdrawn. Therefore, the trash can be easily withdrawn.

In the above beach cleaner, the trash withdrawing member may have a side wall, a bottom wall and a rear wall, the bottom wall and the rear wall may be designed in a mesh-like shape, and the rear wall may be provided so as to slope backward.

According to the above construction, trash and sand which are scraped up by the separator can be received by the rear wall, and made to slip off along the mesh-like slope surface, so that the trash and the sand can be separated from each other.

A one-step higher front wall portion may be provided to a front end portion of the bottom wall.

According to the above construction, when the trash withdrawing member is vibrated, the trash on the bottom wall can be intercepted by the front wall portion, and thus it can be prevented from dropping to the front end side of the trash withdrawing member.

In the above beach cleaning, the driving force conversion/transmission mechanism may comprise a driving wheel provided coaxially with the wheel, a driven wheel secured to the frame, a driving force transmission mechanism for transmitting driving force to the driving wheel to the driven wheel, a cam portion provided coaxially with the driven wheel, and an arm portion that is rotatably supported on the frame, brought into contact with the cam portion at one end thereof and brought into contact with the trash withdrawing member or the sub frame at the other end thereof.

According to the above construction, the cam portion which rotates in connection with the rotation of the wheel actuates one end of the arm portion, and the other end of the arm portion vibrates the trash withdrawing member vertically, so that the rotational driving force of the wheel can be efficiently converted to vibration.

The driving force conversion/transmission mechanism may have a cam plate that is provided rotatably integrally with an axle of the wheel, and a cam lever that is fitted to the cam plate at one end thereof, supported through a supporting shaft at the center thereof and brought into contact with the trash withdrawing member or the sub frame at the other end thereof.

According to the above construction, the trash withdrawing member can be vertically vibrated with a simple mechanism constructed by the cam plate and the cam lever, and the rotational driving force of the wheel can be efficiently converted to vibration.

Furthermore, according to the present invention, a beach cleaner having a frame comprising longitudinal members and lateral members, a ski member that is secured to a front portion of the frame and comes into contact with the surface of a sand area, a towed portion to be towed by a towing vehicle, a separating machine that is provided to a front lower portion of the frame to separate and scrape up trash from the sand area, and a trash withdrawing member that is provided at a rear side of the separating machine and captures, on a mesh member, the trash scraped up onto the frame at the rear side of the separating machine by the separating machine, is characterized in that the trash withdrawing member has a side wall, a bottom wall and a rear wall, the bottom wall and the rear wall are designed in a mesh-like shape, and the rear wall is provided so as to slope backward.

According to this construction, trash and sand which are scraped up by the separator can be received by the rear wall, and made to slip off along the mesh-like slope surface, so that the trash and the sand can be separated.

Effect of the Invention

According to the present invention, there is provided the driving force conversion/transmission mechanism for converting the rotational driving force of the wheel is converted to the vibration force to vibrate the trash withdrawing member. Therefore, vibration is applied to the trash withdrawing member in connection with the rotation of the wheel, and thus the sand invading onto the mesh member can be screened out and prevented from staying there, so that a burden imposed on a worker can be reduced.

Furthermore, the sub frame is secured to the pair of right and left frames so that the rear portion thereof is swingable with the front end being used as a fulcrum, and the trash withdrawing member is secured to the sub frame Therefore, when vibration is applied to the trash withdrawing member, the trash withdrawing member is vibrated with the front end of the sub frame being used as the fulcrum. Therefore, sand invading onto the mesh member can be screened out, and prevented from staying there, so that the burden imposed on the worker can be reduced.

Furthermore, the trash withdrawing member is joined to the sub frame through the hinge at one side thereof in the right-and-left direction and to the detachable mooring hook at the other end thereof, and the trash withdrawing member is rotated sideways with the hinge as a fulcrum (supporting point). Accordingly, when trash is withdrawn, the mooring hook is detached, and the trash withdrawing member is turned over to a side with the hinge as a fulcrum to withdraw trash. Therefore, trash can be easily withdrawn.

Still furthermore, the trash withdrawing member has the side wall, the bottom plate and the rear wall, the bottom wall and the rear wall are designed in a mesh-like shape, and the rear wall is provided so as to slope to the rear side. Accordingly, trash and sand scraped up by the separator can be received by the rear wall, and made to slip down along the mesh-like slope surface. Therefore, the trash and the sand can be separated from each other, and as a result the burden imposed on the worker can be reduced.

The driving force conversion/transmission mechanism has the driving wheel provided coaxially with the wheel, the driven wheel secured to the frame, the driving force transmission mechanism for transmitting the driving force from the driving wheel to the driven wheel, the cam portion provided coaxially with the driven wheel, and the arm portion which is rotatably supported on the frame, brought into contact with the cam portion at one end thereof and brought into contact with the trash withdrawing member or the sub frame at the other end thereof. Accordingly, the cam portion which rotates in connection with the rotation of the wheel actuates one end of the arm portion, and the other end of the arm portion vibrates the trash withdrawing member vertically, whereby the rotational driving force of the wheel can be efficiently converted to vibration.

MODES FOR CARRYING OUT THE INVENTION

Preferred Embodiments according to the present invention will be described hereunder with reference to the drawings.

Figure 1:
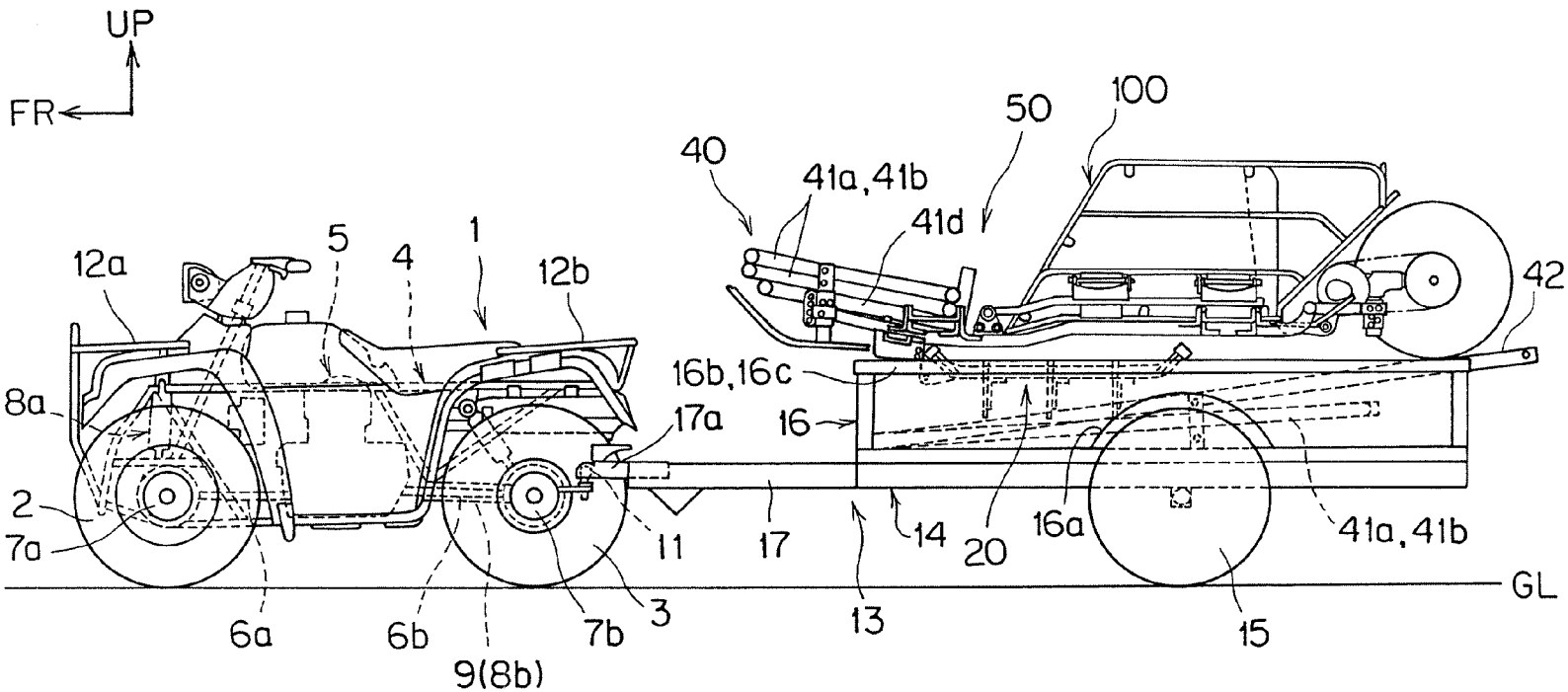
FIG. 1 is a left side view when a beach cleaner according to the present invention, etc. are transported while mounted in a trailer.

FIG. 1 is a side view when a beach cleaner according to an embodiment, etc. are transported while mounted in a trailer.

A vehicle 1 shown in FIG. 1 is constructed as a so-called ATV (All Terrain Vehicle) having right and left front wheels 2 and rear wheels 3 as low-pressure balloon tires which are mounted at the front and rear sides of a compact and light vehicle body thereof and are relatively large in diameter, the minimum ground clearance thereof being set to be high, thereby enhancing running-through performance on irregular ground mainly. The vehicle body frame 4 of the vehicle 1 is configured to have a box-shaped structure which is long in the front-and-rear direction at the center portion in the vehicle width direction, and an engine 5 as a motor for the vehicle 1 is mounted substantially at the center portion of the vehicle frame 4.

The engine 5 is a water-cooled type single cylinder engine, for example, and outputs rotational power of a crank shaft to front and rear propeller shafts 6*a* and 6*b* through a gear engaging type transmission. The rotational power output to each of the front and rear propeller shafts 6*a* and 6*b* is output to the right and left front wheels 2 or rear wheels 3 through front and rear deceleration devices 7*a*, 7*b*.

Here, the vehicle 1 is a so-called semiautomatic vehicle in which the gear ratio of the transmission can be changed by an electrical operation, and thus the gear ratio can be changed, for example through a centrifugal clutch, by only an operation of a change button or the like without performing any clutch operation. The vehicle 1 as described above is more suitable for running under a large running load and running at a fixed speed as compared with a vehicle having a belt type transmission.

The vehicle 1 is not limited to the semiautomatic vehicle, and it may be an automatic transmission vehicle in which the gear ratio is automatically changed, for example.

The right and left wheels 2 are suspended to the front portion of the vehicle body frame 4 through an independent suspension type front suspension 8*a*, and the right and left rear wheels 3 are suspended to the rear portion of the vehicle body frame 4 through a swing arm type rear suspension 8*b*, for example. A trailer hitch 11 for towing the trailer 13 is provided to the rear end portion of a swing arm 9 of the rear suspension 8*b*. In the figures, reference numeral 12*a* represents a front carrier supported on the front portion of the vehicle body frame 4, and reference numeral 12*b* represents a rear carrier supported on the rear portion of the vehicle body frame 4.

The vehicle 1 can tow the trailer 13 for transporting first and second beach cleaners 20, 50 and a trash withdrawing station 40 described later.

The trailer 13 has a pair of right and left wheels 15 at both the sides of the lower portion of the vehicle body frame 14 thereof, a box-shaped loading portion 16 which is upwardly opened, shallow in the vertical direction and provided above the vehicle body frame 14, and a towing arm 17 which is provided so as to extend forwardly from the lower side of the front portion of the vehicle body frame 14. A hitch coupler 17*a* corresponding to the trailer hitch 11 is provided to the front end portion of the towing arm 17.

The vehicle body frame 14 is designed to be square-shaped in top view, and the loading portion 16 is provided to be substantially overlapped with the vehicle body frame 14 in top view. The loading portion 16 is constructed by mounting plate members on a frame-shaped frame to form front, back, right and left wall portions and a bottom wall portion. Wheel houses 16*a* corresponding to the right and left wheels 15 are formed at both the right and left sides of the bottom wall portion of the loading portion 16 so as to be swollen upwardly.

Parts of respective divided bodies constituting the trash withdrawing station 40 are mounted in the loading portion 16, and the first and second beach cleaners 20, 50 and parts of the respective divided bodies are mounted on the loading portion 16. The trailer 13 is towed by the vehicle 1 under the loading state as described above, whereby the respective beach cleaners 20, 50 and the trash withdrawing station 40 can be transported to a predetermined working place. In the following description, sites forming the right and left upper edge portions of the loading portion 16 of the frame concerned are right and left side portions 16*b*, 16*c*, respectively.

Figure 2:
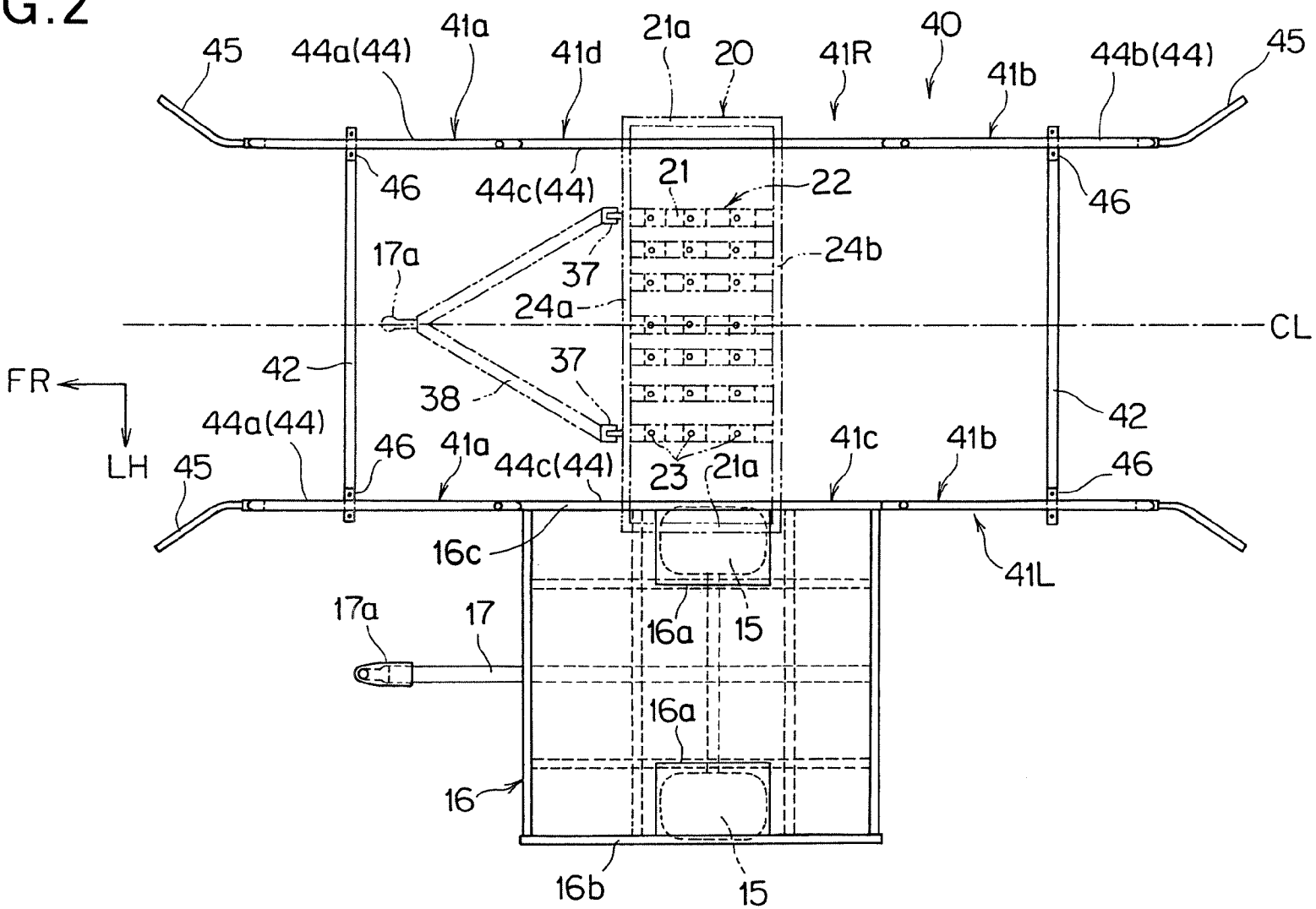
FIG. 2 is a plan view showing a state that a first beach cleaner is lifted up to a trash withdrawing station.

The respective beach cleaners 20, 50 and the trash withdrawing station 40 shown in FIG. 1 are illustrated as being under a loading state on the trailer 13, and the respective beach cleaners 20, 50 and the trash withdrawing station 40 shown in FIG. 2 and subsequent figures are illustrated as being under a use state on the sand soil unless particularly described. In the following description as shown in FIG. 1, the state that both the wheels 15 of the trailer 13 come into contact with the ground and the loading portion 16 is kept in a substantially horizontal position at a predetermined height is referred to as "towing state of trailer 13" in some cases.

In the figures, a line GL represents the land surface (sand surface), a line CL (FIG. 2) represents the center with respect to the right-and-left direction of the vehicle 1, the respective beach cleaners 20, 50 and the trash withdrawing station 40 through which the beach cleaners 20, 50 are passed (hereinafter referred to as "vehicle, etc."), an arrow FR represents the front side in the running direction (front-and-rear direction) of the vehicle, etc., an arrow UP represents the upward direction in the up-and-down direction of the vehicle, etc., and an arrow LH (FIG. 2, FIG. 5 and FIG. 7) represents a leftward direction in the right-and-left direction of the vehicle, etc.

Each of the beach cleaners 20, 50 withdraws various trash strewn on the sand while it is towed by the vehicle 1 and runs on the sand (sand beach) such seashore or the like. The trash collected by each of the beach cleaners 20, 50 is collectively withdrawn at the trash withdrawing station 40 mounted at a predetermined place on the sand. The respective beach cleaners 20, 50 and the trash withdrawing station 40 are constructed by arbitrarily assembling plural kinds of steel products such as stainless, etc. with joint means such as welding or the like. The respective beach cleaners 20, 50 may be towed by the tractor.

Figure 3:
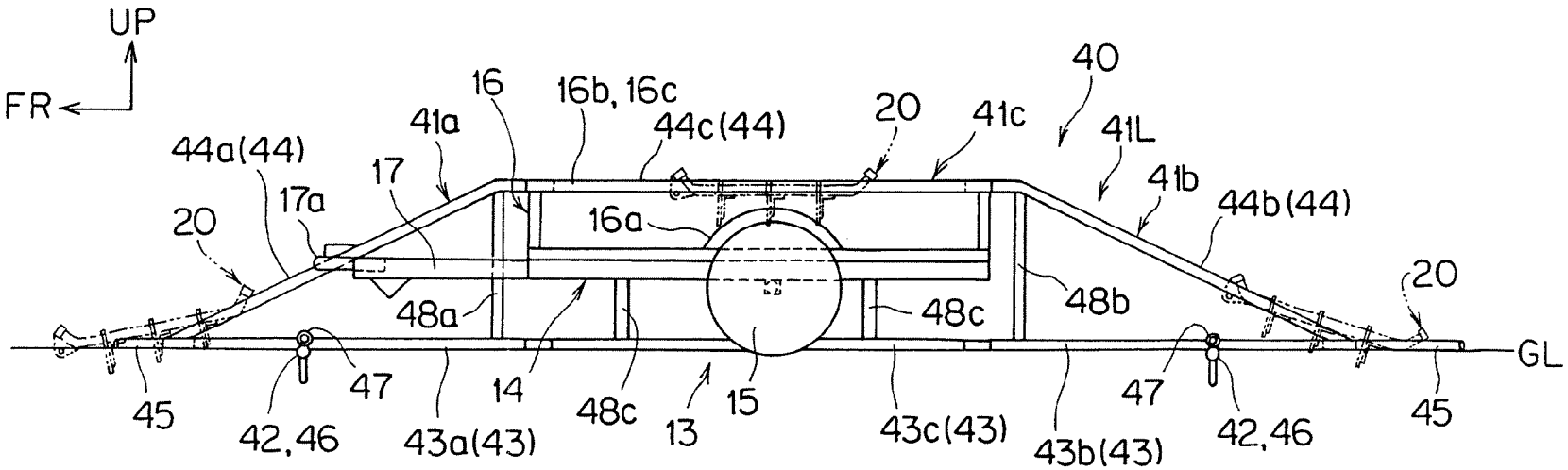
FIG. 3 is a left side view showing a state that the first beach cleaner is lifted up to the trash withdrawing station.

FIG. 2 is a plan view showing a state that the first beach cleaner 20 is lifted up to the trash withdrawing station 40, and FIG. 3 is a left side view showing a state that the first beach cleaner 20 is lifted up to the trash withdrawing station 40.

As shown in FIG. 2, the first beach cleaner 20 is constructed by arranging plural (for example, fifteen) longitudinal members 21 extending along the running direction at even intervals in the width direction (right-and-left direction) to form a drainboard type frame 22, and detachably securing plural downwardly-projecting sand pins 23 to the respective longitudinal members 21. The first beach cleaner 20 has a symmetrical structure with respect to the right-and-left direction.

The longitudinal member 21 is constructed by disposing a circular steel pipe (rectangular steel pipe) along the front-and-rear direction and obliquely bending the front and rear end portions thereof to the upper front or upper rear side.

Front and rear lateral members 24*a*, 24*b* extend to right and left outside positions which are further outside the outermost longitudinal members 21, and side longitudinal members 21*a* which are bent like the longitudinal members 21 bridges the end portions of the front and rear lateral members 24*a*, 24*b* at the right and left sides.

The frame 22 constructed by these members is a laterally elongated rectangular shape in top view, and the right-and-left width thereof is set to be larger than the right-and-left width of the vehicle 1 (see FIG. 1) and the right-and-left width between right and let side structures 41R and 41L of the trash withdrawing station 40 described later. When the first beach cleaner 20 towed by the vehicle 1 gets between the right and left side structures 41R and 41L, both the right and left side portions of the frame 22 get on the right and left side structures 41R, 41L, whereby the first beach cleaner 20 is lifted up to a predetermined height. The right-and-left width between the right and left side structures 41R and 41L is set to be larger than the right-and-left width of the vehicle 1, and thus the vehicle 1 can pass through the gap between the right and left side structures 41R and 41L.

The first beach cleaner 20 as described above runs on the sand, whereby relatively large-size strewn trash (ropes, nets, wood offcuts, etc.) are hooked or entangled to the respective sand pins 23 to be scooped up.

Towing portions 37 for towing the first beach cleaner 20 by the vehicle 1 are provided to the front portions of third longitudinal members 21 from the right and left outer ends of the frame 22, for example. The towing portions 37 are formed of thick plates extending perpendicularly to the right-and-left directions, and joint holes (not shown) are formed at the front end portions thereof. One ends of a towing rod 38 which is joined to the trailer hitch 11 of the vehicle 1 at the other end thereof are joined to the joint holes, and the first beach cleaner 20 is towed by the vehicle 1 through the towing rod 38.

By providing plural joint holes in the up-and-down direction, the optimum towing position corresponding to biting of the first beach cleaner 20 into the sand or the like can be set in accordance with which one of the joint hole is fitted to the one end of the towing rod 38. Furthermore, the towing rod 38 extends from the other end thereof jointed to the trailer hitch 11 to the right and left towing portions 37 like V-shape or Y-shape in top view, and the other end of the towing rod 38 is provided with the hitch coupler 17*a* corresponding to the trailer hitch 11.

With respect to the trash withdrawing station 40, as shown in FIG. 3, when the first beach cleaner 20 is lifted up, each sand pin 23 is sufficiently separated from the sand surface, and also trash scraped and collected by the respective sand pins 23 can be dropped onto the sand, whereby the trash concerned can be collectively withdrawn.

As shown in FIGS. 2 and 3, the trash withdrawing station 40 is constructed by integrally joining the right and left side structures 41R and 41L through a pair of front and rear joint members 42, and are designed to be symmetrical with each other with respect to the front-and-rear direction and the right-and-left direction except for the structures of the intermediate portions in the front-and-rear direction of the side structures 41R and 41L.

Each of the right and left side structure 41R, 41L is constructed by disposing a guide member 44 formed of a circular steel pipe having a gentle mount-like shape in side view on a ground contact member 43 which is formed of a circular steel pipe and extends along the front-and-rear direction, for example, and integrally joining the front and rear end portions of these members 43 and 44 so that each of the right and left side structures 41R, 41L is designed in a trapezoidal shape in side view.

Foot members 45 which are sloped so as to outwardly extend in the right and left direction toward the front side or rear side in top view are detachably secured to the front and rear end portions of the right and left ground contact members 43. Each foot member 45 is grounded on the sand together with each ground contact member 43, whereby the trash withdrawing station 40 is stably installed while the ground contact area thereof is increased.

The joint members 42 are formed of circular steel pipes extending along the right-and-left direction, for example, and the end portions thereof are detachably fitted in joint pipes 46 provided at the lower portions of the front portions or rear portions of the ground contact members 43, whereby the right and left side structures 41R, 41L are integrally joined to each other. That is, the trash withdrawing station 40 is designed in a relatively large size. Therefore, it can be divided into plural divided parts (the right and left side structures 41R, 41L and the front and rear joint members 42), and further each of the right and left side structures 41R, 41L can be divided into three divided parts in the front-and-rear direction. Specifically, the left side structure 41L can be divided into a front divided part 41*a*, a left intermediate divided part 41*c* and a rear divided part 41*b*, and also the right side structure 41R can be divided into the front divided part 41*a*, a right intermediate divided part 41*d* and the rear divided part 41*b*.

The front and rear joint pipes 46 of the ground contact members 43 are formed of relatively short circular steel pipes extending along the right-and-left direction, and upper outer peripheries thereof are fitted and integrally jointed to cut-out portions formed at the lower portions of the ground contact members 43. That is, the joint pipes 46 project downwardly from the lower surfaces of the ground contact members 43, and bite into the sand to suppress movement of the trash withdrawing station 40 when the trash withdrawing station 40 is installed on the sand.

Fitting pins 47 penetrate through the joint members 42 and the joint pipes 46, and are further inserted into the sand by a predetermined amount. That is, the fitting pins 47 suppresses the movement of the trash withdrawing station 40 from a predetermined position under the installation state of the trash withdrawing station 40. The fitting pins 47 are detached and the joint members 42 are picked out of the joint pipes 46, whereby the trash withdrawing station 40 can be divided into the right and left side structures 41R and 41L and the front and rear joint members 42.

The front divided part 41*a* of each of the right and left side structures 41R and 41L mainly comprises a front slope portion 44*a* of the guide member 44, a front horizontal portion 43*a* of the ground contact member 43 which is located below the front slope portion 44*a*, and a front support member 48*a* which extends substantially vertically so as to bridge the rear end portions of the front slope portion 44*a* and front horizontal portion 43*a*. The rear divided part 41*b* mainly comprises a rear slope portion 44*b* of the guide member 44, a rear horizontal portion 43*b* of the ground contact member 43 which is located below the rear slope portion 44*b*, and a rear support member 48*b* which extends substantially vertically between the front end portions of the rear slope portion 44*b* and rear horizontal portion 43*b*. In this embodiment, the front and rear divided parts 41*a* and 41*b* have the same shape, and they may be arranged back to front.

The left intermediate divided part 41*c* in this embodiment is constructed by the trailer 13 under the towing state. Specifically, the right side portion 16*c* of the loading portion 16 of the trailer 13 under the towing state is a substantially horizontal single rod, and the right side portion 16*c* constitutes a substantially horizontal upper side portion 44*c* of the guide member 44. Furthermore, under the towing state of the trailer 13, the height of the right side portion 16*c* as the right upper edge portion of the loading portion 16 is set to be substantially equal to the height of the upper side portion 44*c* of the guide member 44 under the state that the trash withdrawing station 40 is installed on the sand (use state). The trailer 13 can self-stand through a support leg (not shown) under the towing state.

The rear end portion of the front slope portion 44*a* of the front divided part 41*a* is detachably secured to the front end portion of the right side portion 16*c*, and the front end portion of the rear slope portion 44*b* of the rear divided part 41*b* is detachably secured to the rear end portion of the right side portion 16*c*. The front and rear end portions of the right side portion 16*c* may be undetachably joined to the front and rear end portions of the front and rear slope portions 44*a* and 44*b* by conducting a predetermined coming-off preventing treatment, and also the right side portion 16*c* and the front and rear slope portions 44*a*, 44*b* can be divided from one another by releasing the coming-off preventing treatment.

As described above, a part of the left side structure 41L is constructed by the right side portion 16*c* of the trailer 13, whereby the trailer 13 is located just at the left side of the trash withdrawing station 40 so as to be adjacent to the trash withdrawing station 40 under the installation state of the trash withdrawing station 40.

The right intermediate divided part 41*d* mainly comprises a substantially horizontal upper side portion 44*c* of the guide member 44, an intermediate horizontal portion 43*c* of the ground contact member 43 which is located below the upper side portion 44*c*, substantially vertical plural (in this embodiment, a pair of) intermediate support members 48*c* between the upper side portion 44*c* and the intermediate horizontal portion 43*c*, and it is designed to be ladder-structured in side view. The rear end portion of the front slope portion 44*a* of the front divided part 41*a* is detachably secured to the front end portion of the upper side portion 44*c*, and the front end portion of the rear slope portion 44*b* of the rear divided part 41*b* is detachably secured to the rear end portion of the upper side portion 44*c*. The rear end portion of the front horizontal portion 43*a* of the front divided part 41*a* is detachably secured to the front end portion of the intermediate horizontal portion 43*c*, and the front end portion of the rear horizontal portion 43*b* of the rear divided part 41*b* is detachably secured to the rear end portion of the intermediate horizontal portion 43*c*.

The front and rear end portions of the upper side portion 44*c* and the front and rear end portions of the front and rear slope portions 44*a* and 44*b* are detachably joined to one another by executing a predetermined coming-off preventing treatment, and also the upper side portion 44*c* and the front and rear slope portions 44*a*, 44*b* can be divided by releasing the coming-off preventing treatment. Likewise, the front and rear end portions of the intermediate horizontal portion 43*c* and the front and rear end portions of the front and rear horizontal portions 43*a*, 43*b* are detachably joined to one another by executing a predetermined coming-off preventing treatment, and also they can be divided by releasing the predetermined coming-off preventing treatment. The member corresponding to the intermediate horizontal portion 43*c* may be provided to the left side structure 41L.

The substantially horizontal left side portion 16*b* of the loading portion 16 of the trailer 13 may be used as the upper side portion 44*c* of the guide member 44 as in the case of the right side portion 16*c*. The width in the right-and-left direction between the right and left side portions 16*b* and 16*c* is set to be substantially equal to the width in the right-and-left direction between the right and left side structures 41R and 41L, and the front end portion of the rear slope portion 44*b* of the rear divided part 41*b* is joined to each of the rear end portions of the right and left side portions 16*b* and 16*c* of the loading portion 16, whereby the same construction as the rear half portion under the installation state of the trash withdrawing station 40 can be reproduced.

Accordingly, the first beach cleaner 20 (and the second beach cleaner 50) loaded on the loading portion 16 can be unloaded onto the sand along the upper side portions 44*c* and the rear slope portions 44*b* of the right and left guide members 44, and the first beach cleaner 20 (and the second beach cleaner 50) on the sand can be lifted up onto the loading portion 16 along the rear slope portions 44*b* and the upper side portions 44*c* of the right and left guide members 44. In the following description, the state that the rear divided parts 41*b* are joined to the right and left side portions 16*b* and 16*c* as described above may be referred to as an unloading work state of the trailer 13.

Figure 4:
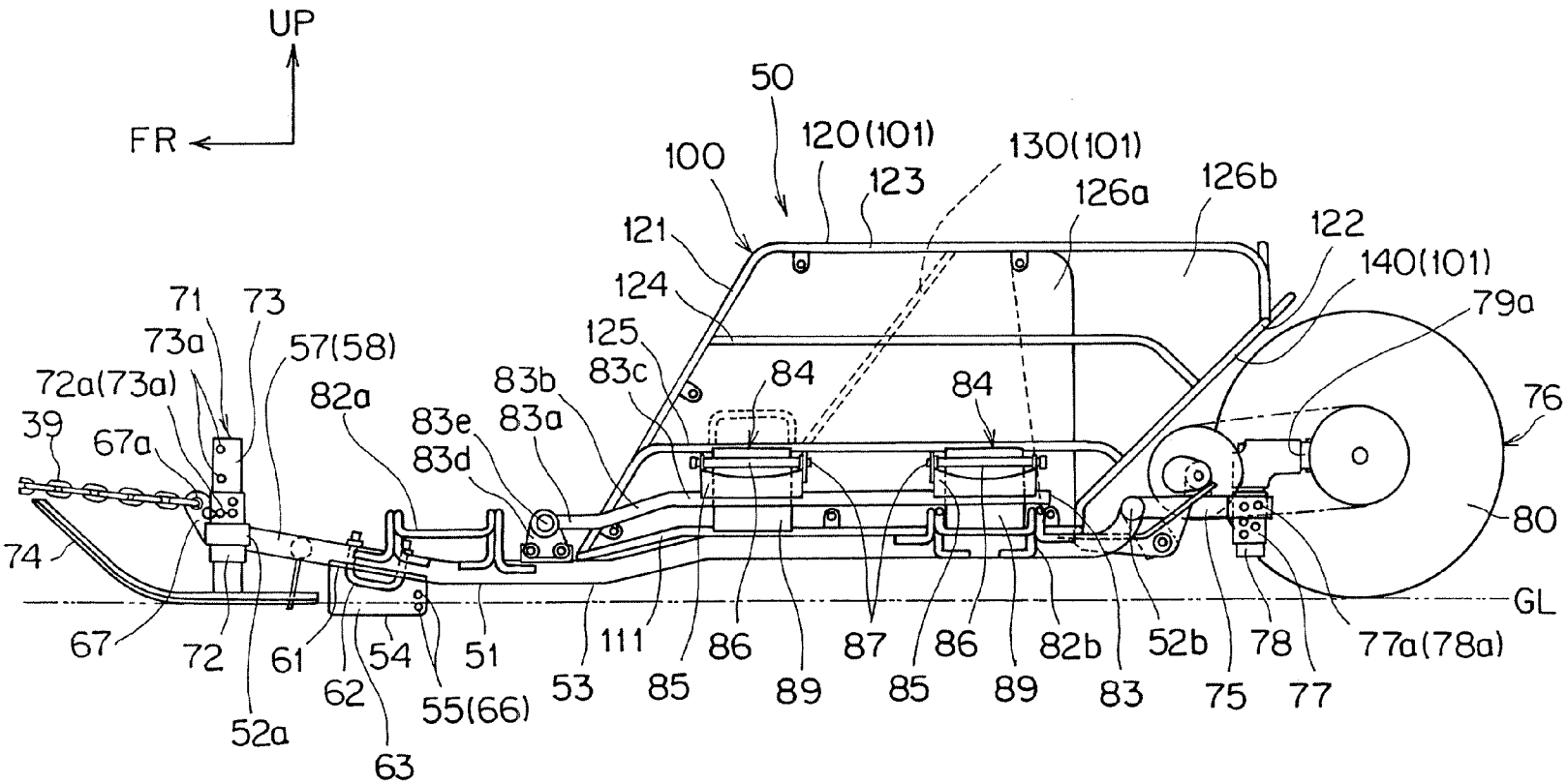
FIG. 4 is a left side view showing a vehicle towing state of a second beach cleaner.
Figure 5:
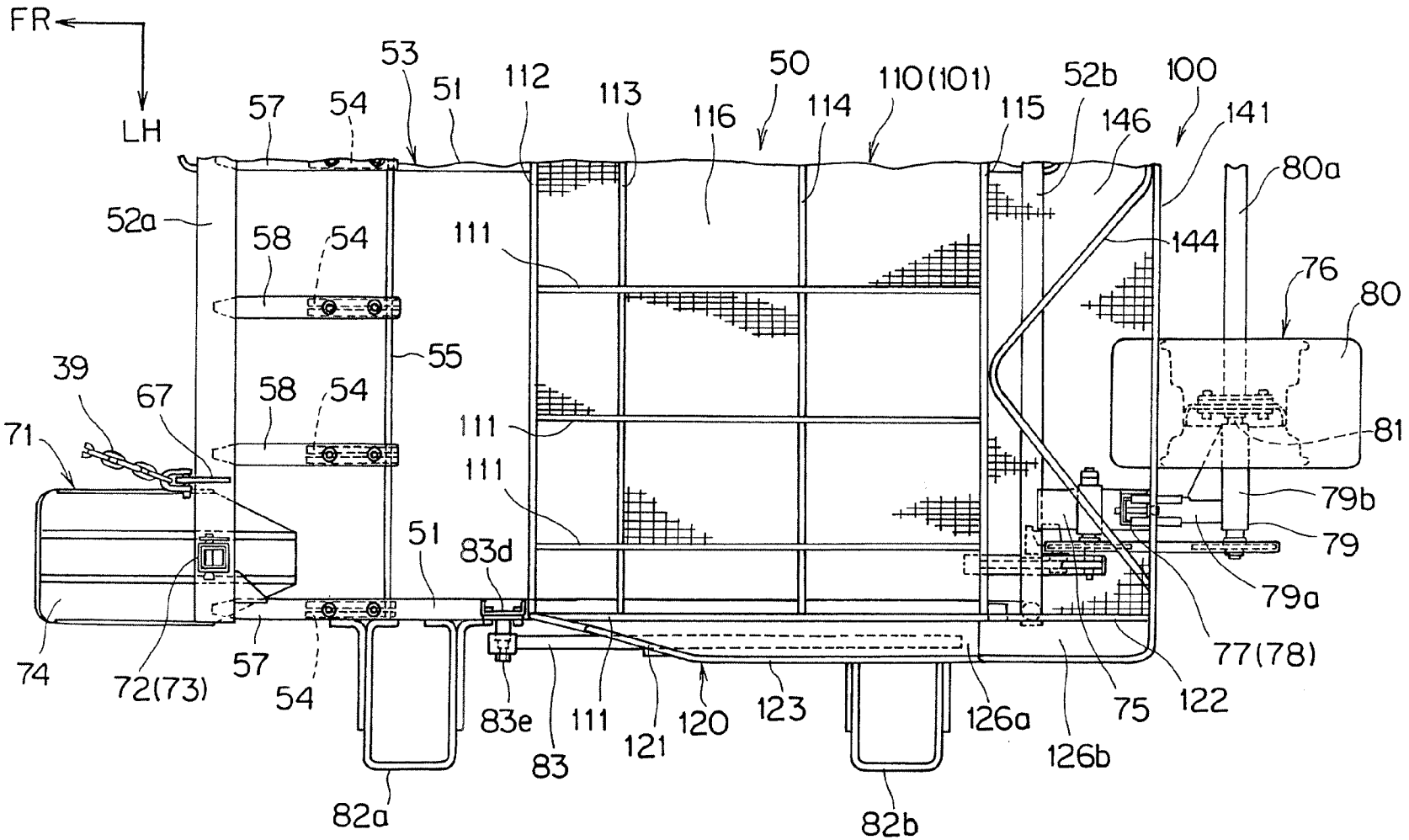
FIG. 5 is a plan view showing a left half of the second beach cleaner.
Figure 6:
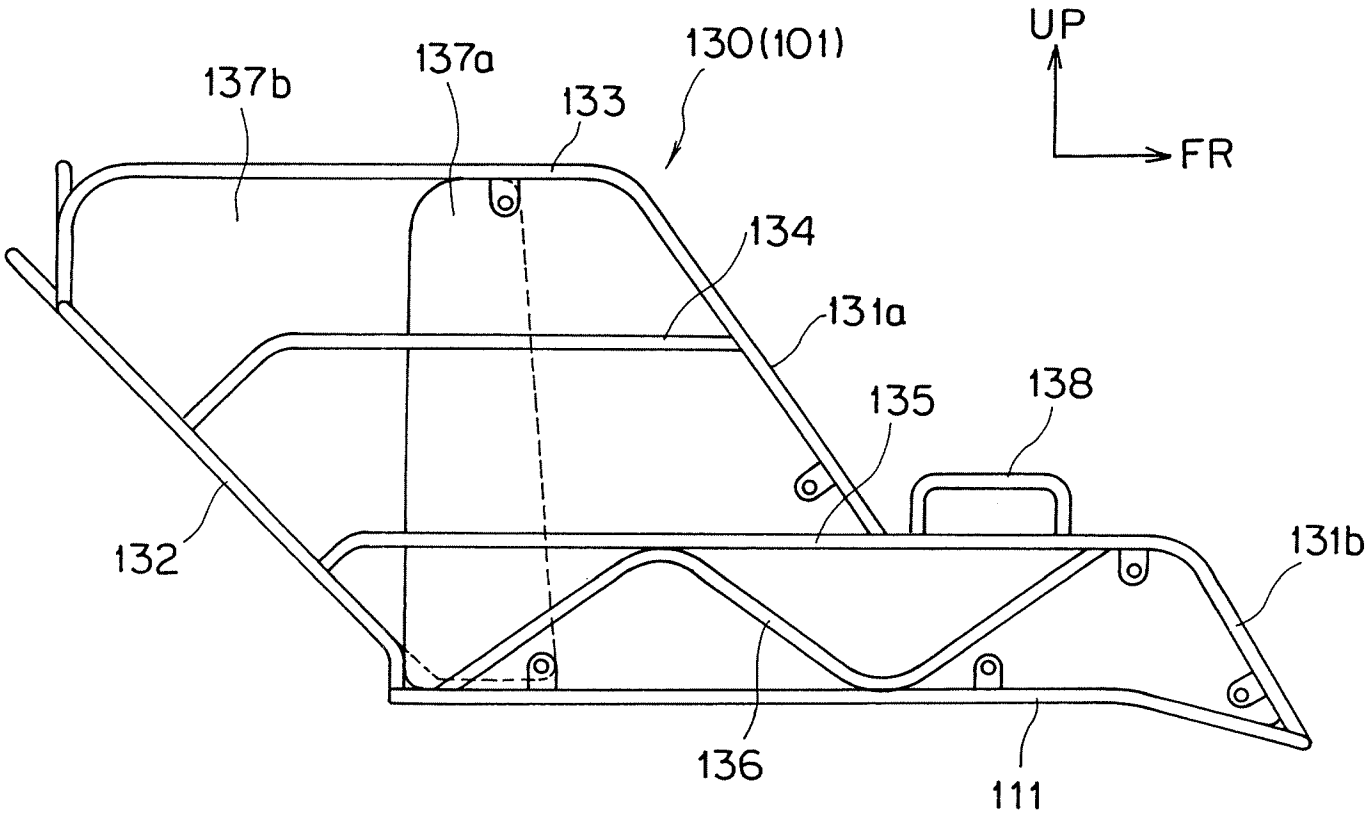
FIG. 6 is a right side view showing a right side wall portion of the second beach cleaner.
Figure 7:
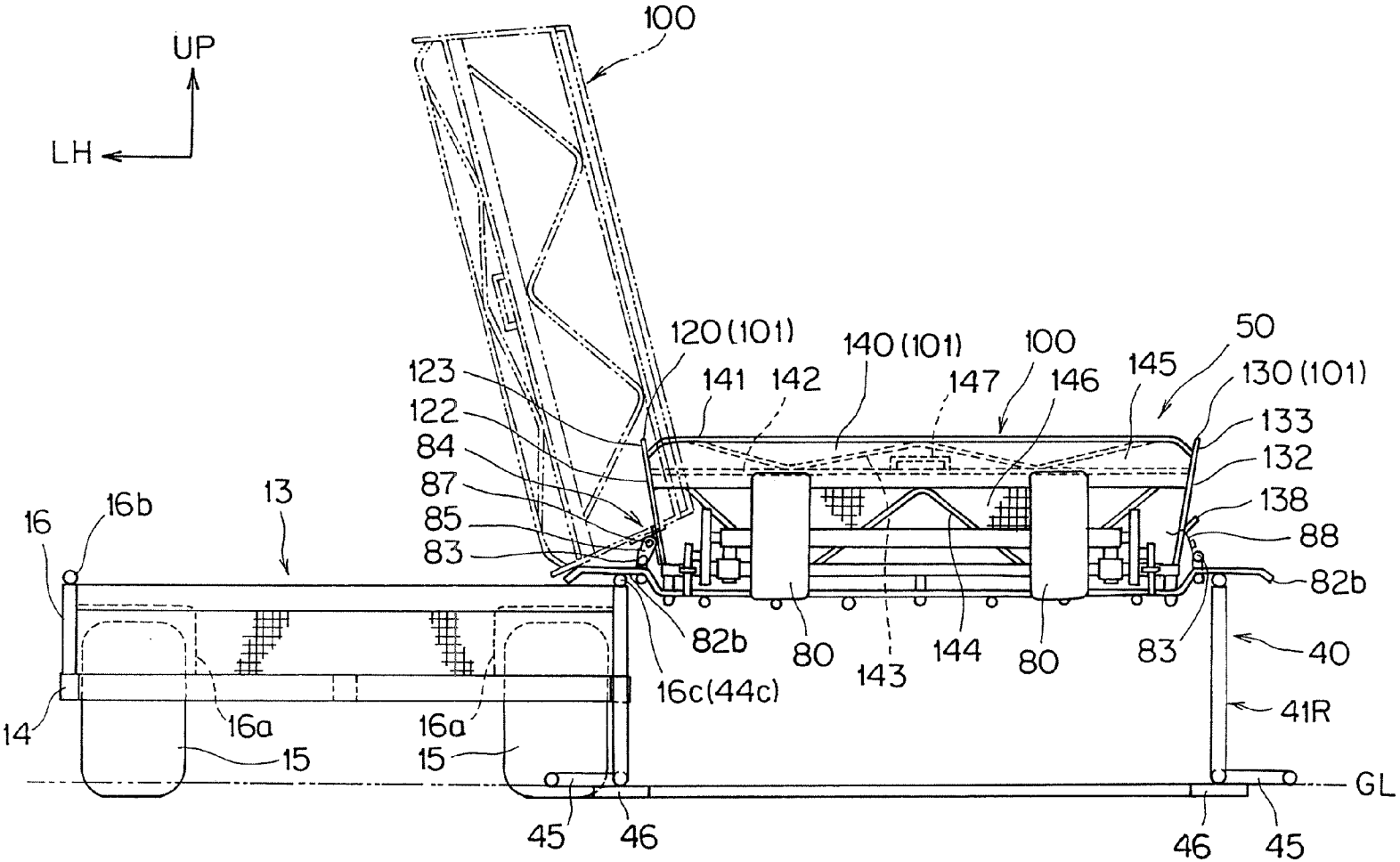
FIG. 7 is a rear view showing a state that the second beach cleaner is lifted up to the trash withdrawing station.

FIG. 4 is a left side view showing a vehicle towing state of the second beach cleaner 50, and FIG. 5 is a plan view showing a left half of the second beach cleaner 50. FIG. 6 is a right side view showing the right side wall portion of the second beach cleaner 50. FIG. 7 is a rear view showing a state that the second beach cleaner 50 is lifted up to the trash withdrawing station 40.

The second beach cleaner 50 has a frame type frame 53 which mainly comprises plural (for example, three) longitudinal members 51 extending along the vehicle running direction and front and rear lateral members 52*a* and 52*b* extending in the width direction (right-and-left direction) substantially perpendicularly to the longitudinal members 51, keels 54 (separating devices) and a scraper 55 (separating device) described later which are provided to the front portion of the frame 53 concerned, and a trash withdrawing member 100 described later which is provided to the rear portion of the frame 53 concerned.

The longitudinal members 51 are constructed by arranging circular steel pipes along the front-and-rear direction and gently cranking the intermediate portions of the circular steel pipes in the front-and-rear direction in side view so that the rear portions thereof are located to be slightly higher than the front portions thereof. At the front portion of the longitudinal member 51, the center portion thereof in the front-and-rear direction is gently bent, and thus the front half portion of the front portion is provided to be slightly sloped to the front and upper side. The front half portion of the front portion of the longitudinal member 51 will be hereunder referred to as a front slope portion 57. The rear end portion of the longitudinal member 51 is provided to be curved to the upper side.

The plural longitudinal members 51 are arranged in juxtaposition with one another in the right-and-left direction so as to be overlapped with one another in side view. The front ends of the longitudinal members 51 are butted and joined from the rear side to a front lateral member 52*a* formed of a rectangular steel pipe extending along the right-and-left direction, for example, and also the rear ends thereof are butted and joined from the lower side to a rear lateral member 52*b* formed of a circular steel pipe extending along the right-and-left direction, for example. The frame 53 which mainly comprises the respective longitudinal members 51 and the lateral members 52*a* and 52*b* is designed in a substantially square shape in top view. The width in the right-and-left direction of the frame 53 is set to be smaller than the width in the right-and-left direction between the right and left side structures 41R and 41L of the trash withdrawing station 40.

Plural (for example, two) scraper frames 58 which are sloped so as to be overlapped with the front slope portions 57 in side view are arranged in juxtaposition with one another in the right-and-left direction between the center longitudinal member 51 in the right-and-left direction and each of the longitudinal members 51 at both the right and left sides. The scraper frame 58 is formed of a circular steel pipe (or rectangular steel pipe) having the same diameter as the longitudinal member 51, the front end thereof is butted and joined from the rear side to the front lateral member 52*a*, and the rear end thereof is set as a free end which is not joined to any member.

The front slope portion 57 of each longitudinal member 51 and each scraper frame 58 are provided with a keel 54 and a scraper 55 as separating devices for separating sand and relatively small trash (drink containers, paper scraps, stub of cigarette, etc.) from the sand and scraping up them when the second beach cleaner 50 runs while being towed.

The keel 54 is detachably secured to the rear portion of the front slope portion 57 of the longitudinal member 51 and the rear portion of each scraper frame 58, and it has a plate member 61 which is curved so as to be fitted to the outer surface of the lower portion of the front slope portion 57 or the scraper frame 58, a U-shaped pin 62 which is designed in an U-shape so as to be opened upwardly in side view and penetrates through the plate member 61 at both the side portions thereof, and a keel body 63 which is designed in a planar shape so as to be substantially perpendicular to the right-and-left direction and extends from the lower end edge of the plate member 61 downwardly.

Plural scarper support holes 66 are formed at the rear end portion of the keel 54 (keel body 63), and the scraper 55 is inserted and supported in each scraper support hole 66. The scraper 55 is designed in a rod-like shape so as to extend along the right-and-left direction and be circular in cross-section, and it is supported by the keels 54 while penetrating through the upper and lower scraper support holes 66 so as to bridge the respective keels 54. The scraper 55 can be selectively supported in conformity with the condition of sand beach or trash, and plural scrapers 55 may be supported. Both end portions of the scraper 55 is subjected to the coming-off preventing treatment for preventing the scraper 55 from come off from each keel 54 by inserting a predetermined locking pin or the like. The cross-sectional shape of the scraper 55 is not limited to a circular shape, but it may be a semi-circular shape having an upper surface sloping to the lower front side, for example. The number of the scrapers 55 may be set to one or three or more, and they may be juxtaposed with one another not only in the up-and-down direction, but also in the right-and-left direction or obliquely.

Each keel 54 and the scraper 55 are set so as to sink into the sand by a proper amount, and when the second beach cleaner 50 runs under this state, each keel 54 scrapes and separates sand and trash, and also each scraper 55 scrapes up them, whereby the scraped up sand and trash are thrown into the trash withdrawing member 100 at the rear portion of the frame 53.

A towed portion (a portion to be towed) 67 through which the second beach cleaner 50 is towed by the vehicle 1 (see FIG. 1) is provided at the front side of a first scraper frame 58 from an outer end in the right-and-left direction of the frame 53, for example. The towed portion 67 is designed like a thick plate to be perpendicular to the right-and-left direction, and a joint hole 67*a* is formed in the towed portion 67. One end of a towing chain 39 which is joined to the trailer hitch 11 (see FIG. 1) of the vehicle 1 at the other end thereof is joined to the joint hole 67*a*, and the second beach cleaner 50 is towed by the vehicle 1 through the towing chain 39.

Furthermore, a front ski support pipe 72 for supporting a front ski leg 71 is provided to the front side of the scraper frame 58 at each outermost side in the right-and-left direction of the frame 53. The front ski support pipe 72 is formed of a rectangular steel pipe which vertically penetrates through a front lateral member 52*a*, and it can be inserted and supported in a leg member 7 which is also formed of a rectangular steel pipe in the front ski leg 71. The front ski leg 71 serves to set the ground height (the height from the surface of the sand) of the front portion of the second beach cleaner 50 to a predetermined height and also enhance sliding performance to the sand, and it comprises a front ski plate (ski member) 74 which is curved to the upper front side at the front portion thereof and has a predetermined width, and a leg member 73 which is provided on the front ski plate 74 so as to be erected from the front ski plate 74.

Right and left through holes 72*a* are formed in the front ski support pipe 72, and plural (for example, four) right and left through holes 73*a* corresponding to the right and left through holes 72*a* are vertically formed in the leg member 73. Any one of the right and left through holes 73*a* is overlapped with the right and left through holes 72*a* of the front ski support pipe 72 and a predetermined locking pin or the like is inserted into these holes, whereby the height of the front portion of the frame 53 with respect to the front ski leg 71 is determined and thus the ground height of the front portion of the second beach cleaner 50 is set to a predetermined height. That is, the ground height of the front portion of the second beach cleaner 50 can be adjusted in accordance with any one of the right and left through-holes 73*a* of the leg member 73 in which the locking pin or the like is inserted, whereby the sinking amount at which each keel 54 and the scraper 55 sink in the sand can be adjusted.

Rear legs 76 are supported at both sides of the rear portion of the rear lateral member 52*b*. The rear legs 76 comprise extension frames 75 extending from both the sides of the rear portion of the rear lateral member 52*b*, rear leg support pipes 77 penetrating vertically through the rear end portions of the extension frames 75, leg members 78 inserted through the rear leg support pipes 77, arm members 79 each of which has an arm 79*a* extending from the upper portion of the leg member 78 backwardly and an arm 79*b* extending from the rear end portion of the arm 79*a* to the inside of the vehicle, right and left wheels 80 whose centers are joined to each other through an axle 80*a*, and rotating shafts 81 which are inserted in the arms 79*b* and provided coaxially with the centers. The rear legs 76 serve to set the ground height (the height from the sand surface) of the rear portion of the second beach cleaner 50 to a predetermined height.

Two right and left through holes 77*a* are formed in the rear leg support pipe 77, and plural (for example, six) right and left through-holes 78*a* corresponding to the right and left through holes 77*a* are formed in the leg member 78 so as to be arranged in the height direction. Any one of the right and left through holes 78*a* is overlapped with the right and left through holes 77*a* of the rear leg support pipe 77 and a predetermined locking pin or the like is fitted in these through holes, whereby the height of the rear portion of the frame 53 with respect to the rear leg 76 is determined and thus the ground height of the rear portion of the second beach cleaner 50 is set to a predetermined height.

As described above, the securing height of the rear portion of the second beach cleaner 50 from the ground surface GL can be adjusted in accordance with any one of the right and left through holes 78*a* of the leg member 78 in which the locking pin or the like is fitted, and thus the sinking amount at which each keel 54 and the scraper 55 sink into the sand can be adjusted. Therefore, the second beach cleaner 50 can effectively remove trash by adjusting the sinking amount of each keel 54 and the scraper 55 in the sand in accordance with the condition of the sand, so that the burden imposed on a worker can be reduced.

Front and rear lift arms 82*a* and 82*b* are provided at the right and left outsides of the front and rear portions of the frame 53 so as to protrude from the ends of the right and left outsides outwardly in the right-and-left direction. Each of the lift arms 82*a* and 82*b* is designed in a frame-like shape so as to be laterally elongated square-shaped in top view, for example. The intermediate portion thereof in the right-and-left direction is formed to be substantially horizontal, the inside portion thereof in the right-and-left direction is bent to extend obliquely to the lower inside and the outside portion thereof in the right-and-left direction is bent to extend obliquely to the lower outside. The width in the right-and-left direction between the outside ends of the respective lift arms 82*a*, 82*b* is set to be broader than the width in the right-and-left direction between the right and left side structures 41R and 41L of the trash withdrawing station 40 (in other words, it is set to be substantially equal to the width in the right-and-left direction of the frame 22 of the first beach cleaner 2). When the second beach cleaner 50 gets into the gap between the right and left side structures 41R and 41L, the respective lift arms 82*a*, 82*b* get on the right and left side structures 41R and 41L, whereby the second beach cleaner 50 is lifted up by a predetermined amount.

A pair of right and left sub frames 83 are provided to the right and left longitudinal members 51 so as to extend over the front and rear sides of the trash withdrawing member 100. The sub frame 83 is bent in side view in conformity with the shape of the longitudinal member 51. The front end portion 83*a* of the sub frame 83 is formed substantially horizontally, a front portion 83*b* at the rear side of the front end portion 83*a* is sloped so as to extend to the slightly lower front side and a rear portion 83*c* at the rear side of the front portion 83*b* is formed substantially horizontally. A frame bracket 83*d* is secured to the horizontal portion of the longitudinal member 51 located at the front portion of the trash withdrawing member 100. The front end portion 83*a* of the sub frame 83 is supported on the frame bracket 83*d* through a turning shaft (front end) 83*e* extending along the right-and-left direction. Accordingly, the sub frame 83 is supported on the frame 53 so as to be swingable vertically with the turning shaft 83*e* being used as a fulcrum (supporting point).

A pair of hinge brackets 85 constituting a part of a hinge 84 for supporting the left side portion of the trash withdrawing member 100 so that the trash withdrawing member 100 is turnable are provided in the front-and-rear direction. A hinge pipe 86 is disposed in connection with the hinge bracket 85 at the left side of the trash withdrawing member 100, and the hinge pipe 86 is supported through a hinge shaft 87 extending along the front-and-rear direction by the hinge bracket 85 so as to be freely turnable. The hinge pipe 86 and the hinge shaft 87 are provided on the same axis.

A mooring hook 88 for regulating the turning of the trash withdrawing member 100 is secured to the sub frame 83 at the right side. The mooring hook 88 is formed by folding a metal plate in conformity with the shape of the sub frame 83 and fixing one end of the metal plate to a metal plate main body by a bolt. The other end of the mooring hook 88 is folded so as to be moored to the frame of the trash withdrawing member 100 (a joint frame 135 described later).

When the second beach cleaner 50 is lifted up in the trash withdrawing station 40, the trash withdrawing member 100 at the rear portion of the frame 53 ascends to a predetermined height. At this time, the mooring hook 88 is detached from the frame of the trash withdrawing member 100, and the trash withdrawing member 100 is turned through the hinge 84 at the left side thereof, whereby the work of withdrawing trash collected in the trash withdrawing member 100 can be easily performed. At this time, the trailer 13 is adjacent to the left side of the trash withdrawing station 40, and thus the trash concerned can be directly thrown into the loading portion 16 of the trailer 13.

The trash withdrawing member 100 is designed in a box-shape to be opened frontward and upward, and for example, it is formed by securing a metal net or plate having a mesh of a predetermined size to a frame-type frame which is mainly formed of a steel pipe, for example. The trash withdrawing member 100 is provided so as to extend from a position at a slightly front side of the center in the front-and-rear direction of the frame 53 to a neighborhood of the rear end portion of the frame 53 with respect to the front-and-rear direction and also so as to have substantially the same width in the right-and-left direction of the frame 53 with respect to the right-and-left direction.

The trash withdrawing member 100 has a bottom wall portion (bottom plate) 110 which has a laterally elongated rectangular shape in top view, right and left side wall portions (side walls) 120 and 130 which are slightly obliquely erected from both the side edges of the bottom wall portion 110 so as to extend more outwardly in the right-and-left direction toward the upper side thereof, and a rear wall portion (rear wall) 140 which is sloped from the rear edge of the bottom wall portion 110 to the lower front side. The right and left side wall portions 120 and 130 and the rear wall portion 140 constitute a surrounding portion 101 which surrounds the periphery of the bottom wall portion 110 while only the front side of the bottom wall portion 110 is opened so that trash scraped up by each keel 54 and the scraper 55 can be collected on the bottom wall portion 110.

The bottom wall portion 110 is constructed by securing a mesh member 116 such as a metal net or the like onto plural (for example, nine) longitudinal frames 111 extending along the vehicle running direction and lateral frames 112 to 115 extending along the width direction (the right-and-left direction) which is substantially perpendicular to the longitudinal frames 111. The bottom wall portion 110 is formed so as to be bent in conformity with the shape of the longitudinal members 51 in side view, sloped to a slightly lower front side between the lateral frames 112 and 113 and also substantially horizontal among the lateral frames 113 to 115.

The left side wall portion 120 has a front frame 121 which slopes from the front end portion of the longitudinal frame 111 to the lower front side, a rear frame 122 which slopes from the rear end portion of the longitudinal frame 111 to the lower front side, and joint frames 123 to 124 through which the front frame 121 and the rear frame 122 are joined to each other in the front-and-rear direction, and it is designed in a substantially parallelogram shape. The rear frame 122 is formed to be lower than the front frame 121, and the sloping angle thereof is set to 45°, for example. Side plates 126*a* and 126*b* which cover the left side wall 120 are secured inside the front frame 121, the rear frame 122 and the joint frames 123 to 125 in the vehicle width direction.

A pair of hinge plates 89 are provided at the front and rear portions of the left side wall portion 120 in the front-and-rear direction so as to bridge the longitudinal frame 111 and the joint frame 125. Each hinge plate 89 is designed in a plate-like shape so as to be substantially square-shaped in side view, and it is subjected to a thickness-reducing treatment so that the outer edge portion and the diagonal line portion thereof are left and the edge portions thereof in the front-and-rear direction are bent inwardly in the right-and-left direction to form a reinforcing flange. A hinge pipe 86 is integrally jointed to the outer surface of each hinge plate 89.

The right side wall portion 130 is designed as if the upper front portion of the left side wall portion 120 is gouged, and as shown in FIG. 6, it has front frames 131*a*, 131*b* sloping to the lower front side, a rear frame 132 sloping from the rear end portion of the longitudinal frame 111 to the lower front side, joint frames 133 and 134 through which the front frame 131*a* and the rear frame 132 are joined to each other, and a joint frame 135 through which the front frame 131*b* and the rear frame 132 are joined to each other in the front-and-rear direction. A reinforcing frame 136 which is vertically bent to constitute a reinforcing rib is provided between the longitudinal frame 111 and the joint frame 135.

Side plates 137*a* and 137*b* covering the right side wall 130 are secured at the front and rear sides at the inside of the front frames 131*a*, 131*b*, the rear frame 132, the joint frames 133 to 135 and the reinforcing frame 136 in the vehicle width direction. A handle 138 projecting upwardly is provided in front of the joint portion of the joint frame 135 to the front frame 131*a*. The handle 138 is designed in a U-shape so as to be opened downwardly in side view. The upper side portion of the handle 138 is designed to extend along the front-and-rear direction, and sloped so as to protrude more outwardly than the right side wall portion 130.

As shown in FIG. 4 and FIG. 7, the rear wall portion 140 is provided so as to slope to the lower front side, for example, at 45°, and it has a joint member 141 through which the right and left joint frames 123 and 133 are joined to each other in the right-and-left direction, and a joint frame 142 through which the right and left rear frames 122 and 132 are joined to each other in the right-and-left direction. The joint frame 141 is formed substantially at the same height as the right and left joint frames 123 and 133. The joint frame 142 is formed substantially at the same height as the right and left rear frames 122 and 132. A reinforcing frame 143 which is bent vertically to form a reinforcing rib is provided between the joint frames 141 and 142. A reinforcing frame 144 which is bent vertically to form a reinforcing rib is also provided between the lateral frame 115 and the joint frame 142.

A rear plate 145 covering the upper portion of the rear wall portion 140 is secured to the outsides of the joint frames 141, 142 and the reinforcing frame 143 in the vehicle width direction. Furthermore, a mesh member 146 such as a metal net or the like for preventing dropping of trash thrown in the trash withdrawing member 100 is provided inside the lateral frame 115, the joint frame 142 and the reinforcing frame 144. The joint frame 142 is provided with an upwardly projecting handle 147. The handle 147 is designed in a U-shape so as to be opened downwardly in rear view, and it is provided to slope so that the upper side portion thereof extends along the right-and-left direction and also protrudes slightly more outwardly than the rear wall portion 140.

As described above, the rear wall portion 140 is provided so as to slope to the lower front side, and the mesh member 146 is disposed on the rear wall portion 140, whereby trash and sand which are scraped up by the keels 54 and the scraper 55 can be received by the rear wall portion 140 and also made to slip down along the mesh-like slant surface. Therefore, the trash and the sand can be separated from each other, so that the burden imposed on a worker can be reduced. Furthermore, the slope angle of the rear wall portion 140 is set to about 45°, whereby trash and sand can be most effectively separated from each other.

The construction that the rear wall portion 140 is provided so as to slope to the lower front side is not limited to the application to this embodiment. For example, it may be applied to a beach cleaner having ski members in place of the wheels 80, for example.

The left side wall portion 120 of the trash withdrawing member 100 is joined to and supported by the sub frame 83 at the left side through the hinge 84 so as to be freely turnable as described above, and the mooring hook 88 is hooked to the joint frame 35, whereby the turning of the left side wall portion 120 is suppressed. The mooring hook 88 is detached from the joint frame 135 of the trash withdrawing member 100, the trash withdrawing member 100 is turned through the hinge 84 so as to lift the right side of the trash withdrawing member 100 upwardly, and the bottom wall portion 110 thereof is set to an erection state that it stands substantially vertically, whereby trash collected in the trash withdrawing member 100 falls onto the left side wall portion 120 and the trash concerned is discharged to the outside of the trash withdrawing member 100 along the left side wall portion 120.

At this time, by providing the handle 138 to the right side portion 130 of the trash withdrawing member 100, the work of turning the trash withdrawing member 100 to collect trash can be facilitated. Furthermore, the hinge 84 is disposed at one short side (left side) of the laterally elongated trash withdrawing member 100, thereby securing the length from the turning shaft (hinge shaft 87) to the operating portion (the handle 138 at the right side) when the trash withdrawing member 100 is erected, so that the turning operation of the trash withdrawing member 100 can be easily performed.

The side plates 126*a* and 126*b* are mounted on the left side wall portion 120 of the trash withdrawing member 100, whereby the trash concerned can be excellently discharged. The upper edge portion of the left side wall portion 120 of the trash withdrawing member 100 is set to protrude more leftward than the left side structure 41L of the trash withdrawing station 40 under the erection state, and the left side wall portion 120 is sloped to directly throw the trash collected in the trash withdrawing member 100 to the loading portion 16 of the trailer 13 adjacent to the left side of the trash withdrawing station 40.

The trash withdrawing member 100 is supported on the vertically swingable sub frame 83, and thus the trash withdrawing member 100 is configured to be vertically swingable with the turning shaft 83*e* of the sub frame 83 as a support point. The state that the trash withdrawing member 100 is under non-turning state, the trash withdrawing member 100 does not ascend, and the bottom wall portion 110 (for example, the lateral frames 112, 114 and 115) thereof comes into contact with the longitudinal members 51 will be hereunder referred to as a stationary state of the trash withdrawing member 100.

Figure 8:
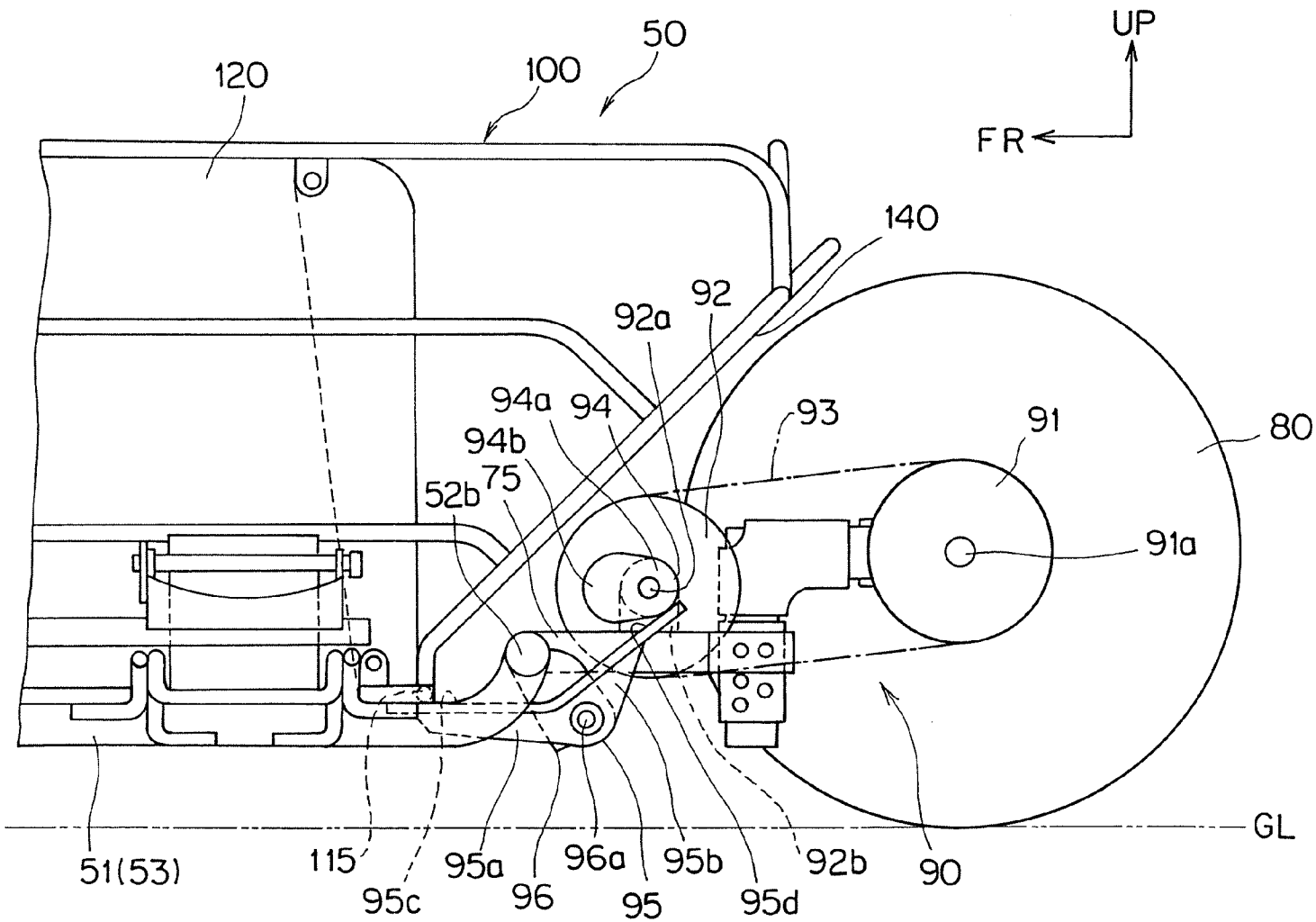
FIG. 8 is a left side view showing a rear portion of the second beach cleaner.
Figure 9:
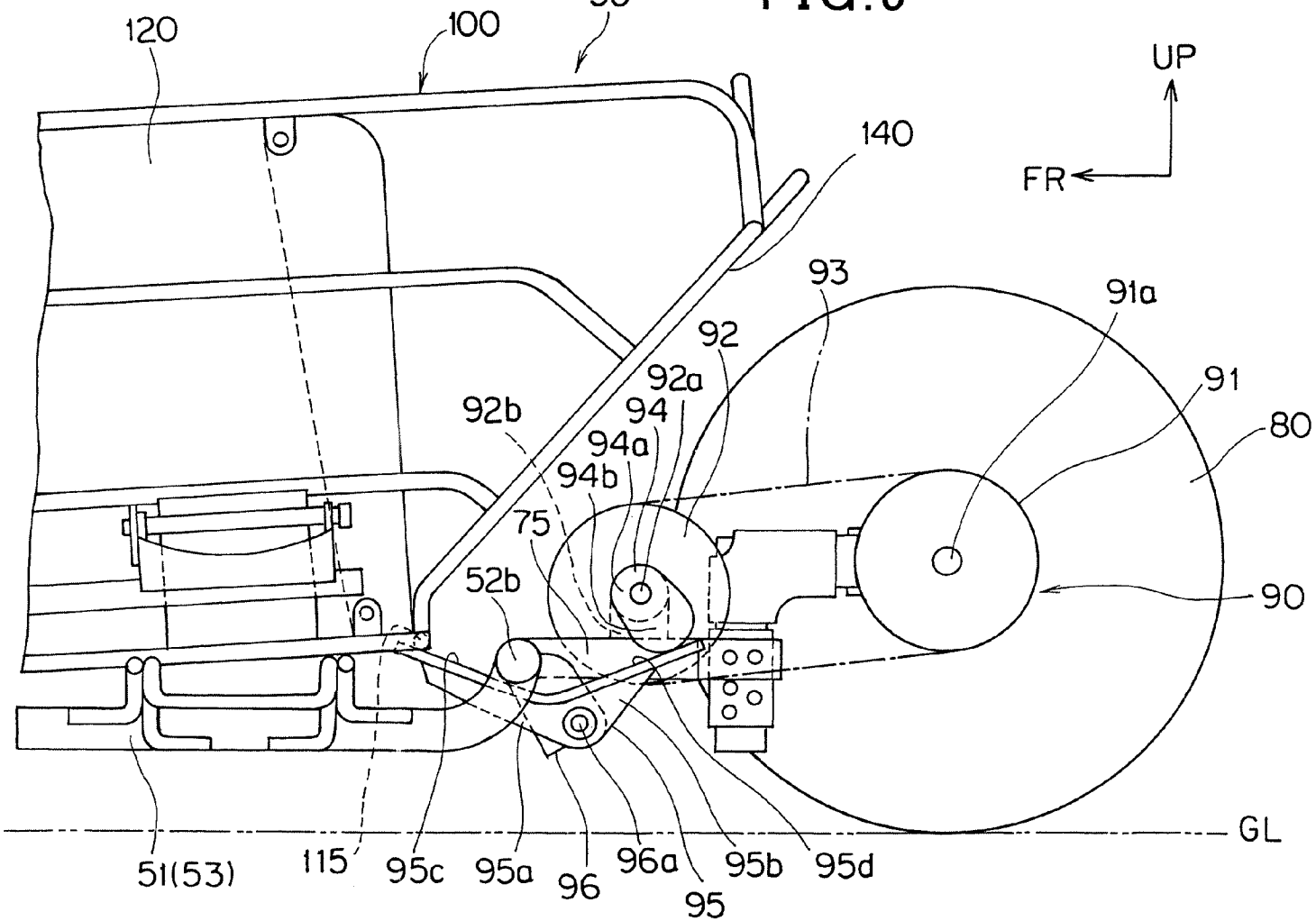
FIG. 9 is a left side view showing a rear portion of the second beach cleaner.

FIG. 8 and FIG. 9 are left side views showing the rear portion of the second beach cleaner 50.

As shown in FIG. 5 and FIG. 8, a pair of right and left driving force conversion/transmission mechanisms 90 for converting the rotational driving force of the wheels 80 to vibration force and transmitting this vibration to the trash withdrawing member 100 is provided at the rear side of the trash withdrawing member 100. Each driving force conversion/transmission mechanism 90 has a driving wheel 91 which is provided coaxially with the wheel 80, a driven wheel 92 provided to the frame 53 in front of the driving wheel 91, a chain (driving force transmission mechanism) 93 for transmitting the driving force from the driving wheel 91 to the driven wheel 92, a cam portion 94 which is provided coaxially with the driven wheel 92, and an arm portion 95 which is rotatably supported on the frame 53.

The driving wheel 91 rotates integrally with the wheel 80, and it is secured to the driving shaft 91*a* which is coaxially connected to the rotating shaft 81. A support member 92*b* which supports the driven shaft 92*a* extending along the right-and-left direction so that the driven shaft 92*a* is rotatable is provided on the upper surface of an extension frame 75. The driven wheel 92 is secured to the driven wheel shaft 92*a* so as to be located on the same plane as the driving wheel 91 and rotatable in the vertical direction. The driven wheel 92 is joined to the driving wheel 91 through the chain 93, and it is configured to rotate interlockingly with the driving wheel 91.

The cam portion 94 rotates integrally with the driven wheel 92, and it is secured to the driven shaft 92*a* at the outside of the driven wheel 92. The cam portion 94 has a base circular portion 94*a* constituting a circular cam face, and a cam protruding portion 94*b* which projects from the base circular portion 94*a* to the outer periphery side and constitutes a protruding cam face. The right and left cam portions 94 are secured while the cam protruding portions 94*b* thereof are positionally aligned with each other, and the cam protruding portions 94*b* rotate in synchronization with each other.

A stay 96 sloping to the upper front side is provided between the rear lateral member 52*b* and the extension frame 75. The arm portion 95 is disposed below the cam portion 94, and supported by the stay 96 so as to be rotatable in the vertical direction through the turning shaft 96*a* extending along the right-and-left direction. The arm portion 95 has a front arm (the other end) 95*a* and the rear arm (one end) 95*b*, and it is designed in a substantially V-shape in side view. A planar frame contact face 95*c* is formed in the front arm 95*a* so as to come into contact with the lateral frame 115 of the trash withdrawing member 100 from the lower side, and a planar cam contact face 95*d* is formed in the rear arm 95*b* so as to come into contact with the cam face of the cam portion 94 from the lower side. The angle between the front arm 95*a* and the rear arm 95*b* is set so that the cam contact face 95*d* comes into contact with the lateral frame 115 of the trash withdrawing member 100 under the stationary state while coming into contact with the base circular portion 94*a*.

In the thus-constructed driving force conversion/transmission mechanism 90, when the wheel 80 is rotated, the driving force of the driving wheel 91 coaxial with the wheel 80 is transmitted to the driven wheel 92 through the chain 93. When the driven wheel 92 is rotated, the cam portion 94 coaxial with the driven wheel 92 rotates, and the cam contact face 95*d* of the arm portion 95 is downwardly pushed by the cam protruding portion 94*b* of the cam portion 94. As shown in FIG. 9, the arm portion 95 rotates clockwise around the turning shaft 96*a*, and the frame contact face 95*c* of the arm portion 95 pushes up the lateral frame 115 of the trash withdrawing member 100. "The principle of leverage" is applied to this operation while the turning shaft 96*a* serves as a fulcrum, the contact portion between the cam contact face 95*d* and the cam protruding portion 94*b* serves as a point of force and the contact portion between the frame contact face 95*c* and the lateral frame 115 serves as a point of action. Therefore, the rotational driving force of the driven wheel 92 can be amplified to push up the lateral frame 115. The trash withdrawing member 100 rotates around the turning shaft 83*e* of the sub frame 83, and the rear portion of the trash withdrawing member 100 ascends.

When the cam protruding portion 94*b* is separated from the cam contact face 95*d*, the arm portion 95 rotates counterclockwise around the turning shaft 96*a* as shown in FIG. 8, and the trash withdrawing member 100 is returned to the stationary state. The cam protruding portion 94*b* repeats the contact/separation thereof with/from the cam contact face 95*d*, whereby the trash withdrawing member 100 vibrates vertically.

The ascending amount of the rear portion of the trash withdrawing member 100 can be changed by changing the protrusion amount of the cam protruding portion 94*b* from the base circular portion 94*a*. That is, when the protrusion amount of the cam protruding portion 94*b* is increased, the ascending amount of the trash withdrawing member 100 increases. When the protrusion amount of the cam protruding portion 94*b* is reduced, the ascending amount of the trash withdrawing member 100 decreases.

Next, the procedure of cleaning the sand beach by using each of the beach cleaners 20 and 50 described above will be briefly described.

First, the respective beach cleaners 20 and 50 and the trash withdrawing station 40 are loaded on the trailer 13, and transported to a predetermined cleaning work place as shown in FIG. 1. Here, each of the beach cleaners 20 and 50 is loaded on the trailer 13 under the state that it is assembled as one body. The trash withdrawing station 40 is loaded on the trailer 13 while divided into the front and rear divided parts 41*a* and 41*b* in the right-and-left direction, the right intermediate divided part 41*d*, the front and rear joint members 42 and the respective frame members 45.

More specifically, a pair of front and rear divided parts 41*a* and 41*b* (or a pair of front or rear divided parts) are loaded on the trailer 13 (mounted in the loading portion 16), and then each of the beach cleaners 20, 50 is loaded on the trailer 13. At this time, the first beach cleaner 20 is loaded under the state that both the side portions of the front and rear lateral members 24*a*, 24*b* of the frame 22 are loaded on the right and left side portions 16*b* and 16*c* of the loading portion 16 (the upper side portion 44*c* of the guide member 44 of the trash withdrawing station 40), and sand pins 23 at both the sides of the rearmost row come into contact with the outer surfaces of the wheel houses 16*a* of the loading portion 16 from the front side, thereby regulating backward movement of the first beach cleaner 20.

Furthermore, the second beach cleaner 50 is loaded to be sloped slightly to the lower rear side so that the longitudinal members 51 of the frame 53 thereof are mounted on the front and rear lateral members 24*a* and 24*b* of the first beach cleaner 20 under the loading state, and each keel 54 comes into contact with the front lateral member 24*a* of the first beach cleaner 20 from the front side, thereby regulating the backward movement of the second beach cleaner 50.

With respect to the trash withdrawing station 40, the other pair of front and rear divided parts 41*a* and 41*b* (or a pair of front or rear divided parts) and the right intermediate divided part 41*d* are mounted so as to be overlapped with the upper side of each front slope portion 57 and the scraper frame 58 of the second beach cleaner 50 under the loading state. Each joint member 42 is mounted at the right side of the loading portion 16 while sloping to the lower front side, for example, and each foot member 45 is mounted at the left side of the rear portion of the loading portion 16, for example.

The loading state of the trash withdrawing station 40 is not limited to the above state. Only the right intermediate divided part 41*d* may be mounted at the upper side of each front slope portion 57 and the scraper frame 58 of the second beach cleaner 50 under the loading state, for example a pair of front and rear divided parts 41*a* and 41*b* may be mounted at the rear side of the second beach cleaner 50 so as to be juxtaposed with each other in the right-and-left direction, and the other pair of front and rear divided parts 41*a* and 41*b* may be mounted in the loading portion 16. At this time, the respective foot members 45 are mounted at the right and left sides of the rear portion of the loading portion 16 while properly shared.

Subsequently, each of the beach cleaners 20, 50 under the loading state is unloaded to the ground. At this time, the rear divided parts 41*b* are joined to the right and left side portions

16*b* and 16*c* of the loading portion 16 of the trailer 13 so that an unloading work state is set, and each of the beach cleaners 20, 50 under the loading state is unloaded along the right and left guide members 44. Accordingly, even when each of these beach cleaners is set to the integrally assembled state, each beach cleaner 20, 50 can be relatively easily unloaded onto the ground, and also shift to the trash withdrawing work can be quickly performed.

Subsequently, the installation work of the trash withdrawing station 40 is executed at a predetermined position on the sand beach. In this work, one rear divided part 41*b* is first detached from the left side portion 16*b* of the loading portion 16 of the trailer 13 under the unloading work state, the rear divided part 41*b* concerned, the right intermediate divided part 41*d* and the front divided part 41*a* are joined to one another to construct the right side structure 41R. Furthermore, the front divided part 41*a* is joined to the right side portion 16*c* of the loading portion 16 of the trailer 13 to construct the left side structure 41L.

The right and left side structures 41R and 41L are joined to each other through the front and rear joint members 42, and also each foot member 45 is secured to a predetermined place, whereby the trash withdrawing station 40 can be assembled under the installation state. At this time, the trash withdrawing station 40 having a relatively large size is loaded on the loading portion 16 while divided into plural divided parts, etc., thereby facilitating the work of unloading the trash withdrawing station 40 from the trailer 13.

Subsequently, the first beach cleaner 20 is made to run on the sand beach at a fixed speed while being towed by the vehicle 1, thereby withdrawing relatively large trash on the sand beach. The first beach cleaner 20 withdraws relatively large trash on the sand beach while each sand pin 23 is made to bite into the sand. Accordingly, the running resistance thereof is relatively large, and thus the running speed is set to a low speed of about 5 to 10 km/h.

As described above, when the first beach cleaner 20 runs on the sand beach and a predetermined amount of trash is collected below the frame 22 thereof, the first beach cleaner 20 temporarily returns to the trash withdrawing station 40, and the work of withdrawing the collected trash is executed. At this time, when the first beach cleaner 20 gets into the gap between the right and left side structures 41R and 41L after the vehicle 1 passes between the right and left side structures 41R and 41L of the trash withdrawing station 40, the right and left side portions of the frame 22 gets on the right and left side structures 41R and 41L of the frame 22, whereby the first beach cleaner 20 is lifted up by a predetermined amount (see FIG. 3). Under the state that the first beach cleaner 20 gets on the upper side portions 44*c* of the guide members 44 of the right and left side structures 41R and 41L, the vehicle 1 and the first beach cleaner 20 are stopped, and the work of withdrawing trash dropped onto the sand is executed. Thereafter, the vehicle 1 and the first beach cleaner 20 are made to run again to repeat the trash withdrawing work described above.

After a predetermined range is cleaned by the first beach cleaner 20, the second beach cleaner 50 is towed to run in the same range, thereby withdrawing relatively small trash on the sand beach. By using the second beach cleaner 50 after the first beach cleaner 20 as described above, the keels 54, the scraper 55, the trash withdrawing member 100, etc. which correspond to minute trash can be suppressed from being damaged. When the second beach cleaner 50 runs, the sand beach is dug up and thus gets flexible by the action of the first beach cleaner 20, and also it is necessary to scrape up sand and trash by each keel 54 and the scraper 55. Therefore, the running speed of the second beach cleaner 50 is set to about 15 to 25 km/h which is slightly higher than the running speed of the first beach cleaner 20.

The running of the second beach cleaner 50 on the sand beach makes each keel 54 and the scraper 55 scrape up relatively small trash together with sand, whereby the trash and the sand are collected in the trash withdrawing member 100 at the rear portion of the frame 53.

At this time, when the trash and the sand which are scraped up by the keels 54 and the scraper 55 impinge against the rear wall portion 140 sloping to the lower front side, they slip down on the mesh member 146, and the sand is screened out from the mesh member 145. Accordingly, the trash and the sand can be separated from each other, so that the burden imposed on the worker can be reduced.

The trash withdrawing member 100 is vertically vibrated by the driving force conversion/transmission mechanism 90 during travel of the second beach cleaner 50. Accordingly, sand captured in the trash withdrawing member 100 is screened out from the trash withdrawing member 100 by this vertical vibration, and thus stay of sand in the trash withdrawing member 100 can be suppressed.

At this time, the right and left cam portions 94 are secured so that the cam protruding portions 94*b* are positionally aligned with each other. Accordingly, the right and left cam protruding portions 94*b* rotate in synchronization with each other, and thus the right and left sides of the trash withdrawing member 100 are vertically vibrated more greatly in the same synchronization as compared with a case where the right and left cam protruding portions 94*b* are positionally displaced from each other, so that sand invading onto the trash withdrawing member 100 can be excellently screened out, and prevented from staying there. In addition, the second beach cleaner 50 can be more greatly suppressed from rolling and thus the keels 54 and the scraper 55 can be brought into stable contact with the ground as compared with the case where the right and left cam protruding portions 94*b* are positionally displaced from each other.

As described above, when the second beach cleaner 50 runs on the sand beach and a predetermined amount of trash is collected in the trash withdrawing member 100 thereof, the second beach cleaner 50 temporarily returns to the trash withdrawing station 40, and the work of withdrawing the collected trash is executed. At this time, when the second beach cleaner 50 gets into the gap between the right and left side structures 41R and 41L after the vehicle 1 passes through the gap between the right and left side structures 41R and 41L of the trash withdrawing station 40, the right and left lift arms 82*a* and 82*b* at the front and rear sides get on the right and left side structures 41R and 41L, and the second beach cleaner 50 is lifted up by a predetermined amount. Then, under the state that the second beach cleaner 50 gets on the upper side portions 44*c* of the guide members 44 of the right and left side structures 41R and 41L, the vehicle 1 and the second beach cleaner 50 are stopped, the trash withdrawing member 100 is turned sideways, and the work of withdrawing the collected trash is executed. Thereafter, the vehicle 1 and the second beach cleaner 50 are made to run again to repeat the trash withdrawing work described above.

Here, when the trash withdrawing member 100 is turned to execute the withdrawing work of the collected trash, the trash concerned is directly thrown into the loading portion 16 of the trailer 13 adjacent to the left side of the trash withdrawing station 40. Therefore, the loading portion 16 can be used as a trash withdrawing container, the withdrawn trash can be transported by the trailer 13 after the cleaning work is finished, and also the work of withdrawing trash dropped onto the ground is not required, so that the number of steps of the cleaning work can be reduced.

As described above, according to this embodiment, there is provided the driving force conversion/transmission mechanism 90 for converting the rotational driving force of the wheel 80 to the vibration force to vibrate the trash withdrawing member 100. Therefore, since the trash withdrawing member 100 is vibrated in connection with the rotation of the wheel 80, sand invading onto the mesh member 116 can be screened out, and prevented from staying there, so that the burden imposed on the worker can be reduced.

According to the above embodiment, the sub frame 83 which is swingable at the rear portion thereof with the turning shaft 83*e* being used as a fulcrum is secured to the pair of right and left longitudinal members 51, and the trash withdrawing member 100 is secured to the sub frame 83. Accordingly, when vibration is applied to the trash withdrawing member 100, the trash withdrawing member 100 is vibrated with the turning shaft 83*e* of the sub frame 83 as a fulcrum. Therefore, sand invading onto the mesh member 116 can be screened out and prevented from staying, so that the burden imposed on the worker can be reduced.

Furthermore, according to the above embodiment, the trash withdrawing member 100 is joined to the sub frame 83 through the hinges 84 at one side in the right-and-left direction and through the detachable mooring hook 88 at the other side, and the trash withdrawing member 100 is sideways turned over with the hinges 84 as a fulcrum, whereby the mooring hook 88 is detached and the trash withdrawing member 100 is turned over sideways with the hinge 84 serving as a fulcrum under trash withdrawal operation, whereby trash can be withdrawn. Therefore, the trash can be easily withdrawn.

Still furthermore, according to the above embodiment, the trash withdrawing member 100 has the right and left side wall portions 120, 130, the bottom wall portion 110 and the rear wall portion 140. The bottom wall portion 110 and the rear wall portion 140 are formed like a mesh, and the rear wall portion 140 is sloped backwardly, so that trash and sand scraped up by the keels 54 and the scraper 55 can be received by the rear wall portion 140 and also made to slip down along the mesh-like slope surface. Therefore, trash and sand can be separated from each other, so that the burden imposed on the worker can be reduced.

According to the above embodiment, the driving force conversion/transmission mechanism 90 has the driving wheel 91 provided coaxially with the wheel 80, the driven wheel 92 secured to the frame 53, the chain 93 for transmitting the driving force from the driving wheel 91 to the driven wheel 92, the cam portion 94 provided coaxially with the driven wheel 92, and the arm portion 94 which is rotatably supported on the frame 53, brought into contact with the cam portion 94 at the rear arm 95*b* and brought into contact with the trash withdrawing member 100 at the front arm 95*a*. Accordingly, the cam portion which is rotated in connection with the rotation of the wheel actuates one end of the arm portion, and the other end of the arm portion vibrates the trash withdrawing member vertically, so that the rotational driving force of the wheel can be efficiently converted to the vibration.

The above embodiment is an example of the present invention, and it is needless to say that it may be properly changed without departing from the subject matter of the present invention.

For example, in the above embodiment, the right and left cam portions 94 are secured so that the cam protruding portions 94*b* thereof are positionally aligned with each other, and thus the cam protruding portions 94*b* are rotated synchronously with each other. However, the right and left cam protruding portions 94*b* may be positionally displaced from each other, so that the right and left sides of the trash withdrawing member 100 are upwardly and downwardly moved separately from each other.

Furthermore, in the above embodiment, a pair of right and left wheels 80 are provided, however, two or more wheels may be provided. In this case, plural wheels may be arranged at the outsides in the vehicle width direction of the front ski plates 74 so that the rear portion of the second beach cleaner 50 is stabilized. Furthermore, only one wheel may be provided to the center CL in the right-and-left direction. In this case, the number of driving force conversion/transmission means may be set to the number of wheels.

Furthermore, in the above embodiment, the front arm 95*a* of the arm portion 95 is brought into contact with the lateral frame 115 of the trash withdrawing member 100, however, the front arm 95*a* of the arm portion 95 may be brought into contact with the sub frame 83.

FIG. 10 to FIG. 13 show another embodiment.

In these figures, the same parts as the above embodiment are represented by the same reference numerals, and the detailed description of the same parts is omitted.

Figure 12:
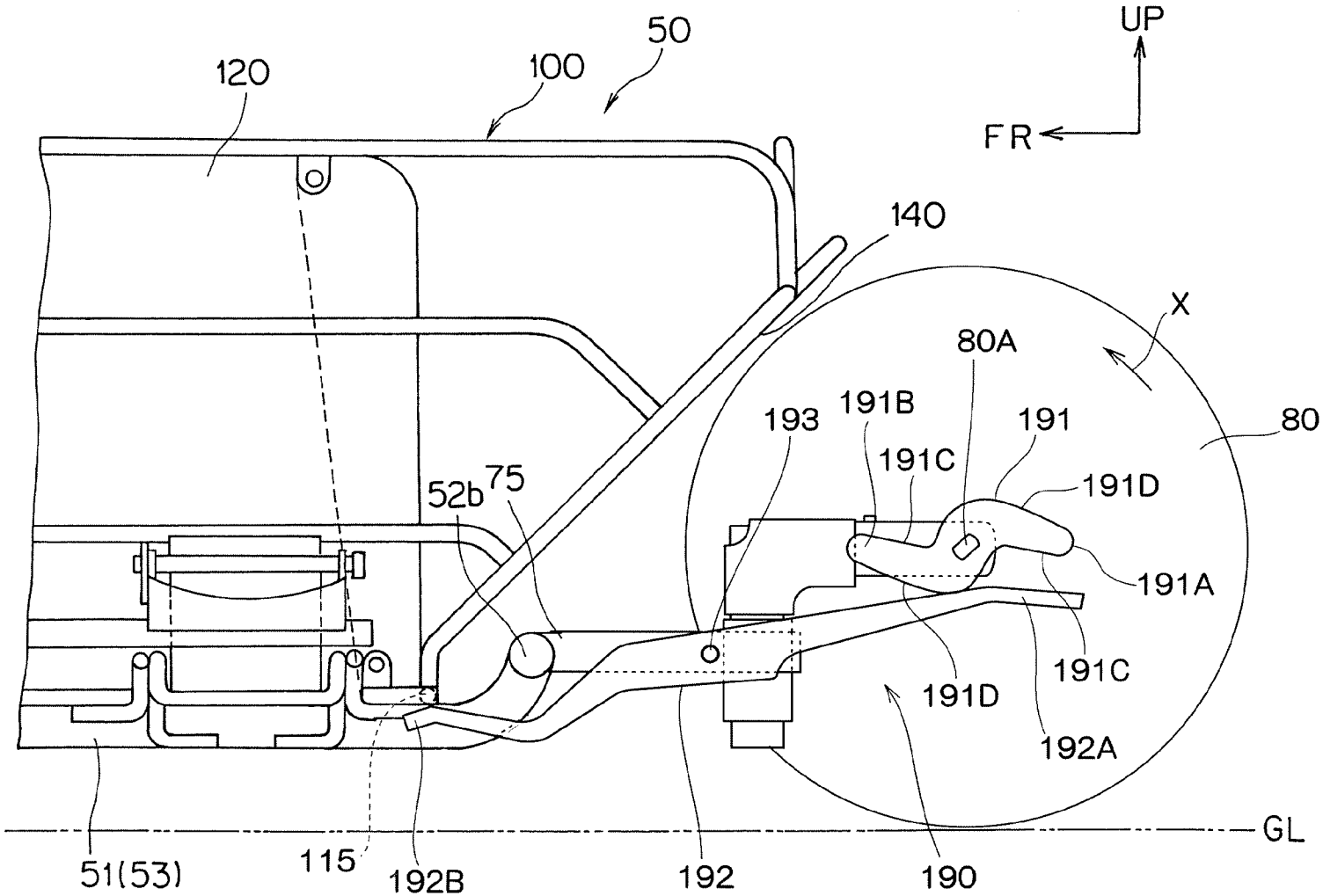
FIG. 12 is a diagram showing the other embodiment which corresponds to FIG. 8.
Figure 13:
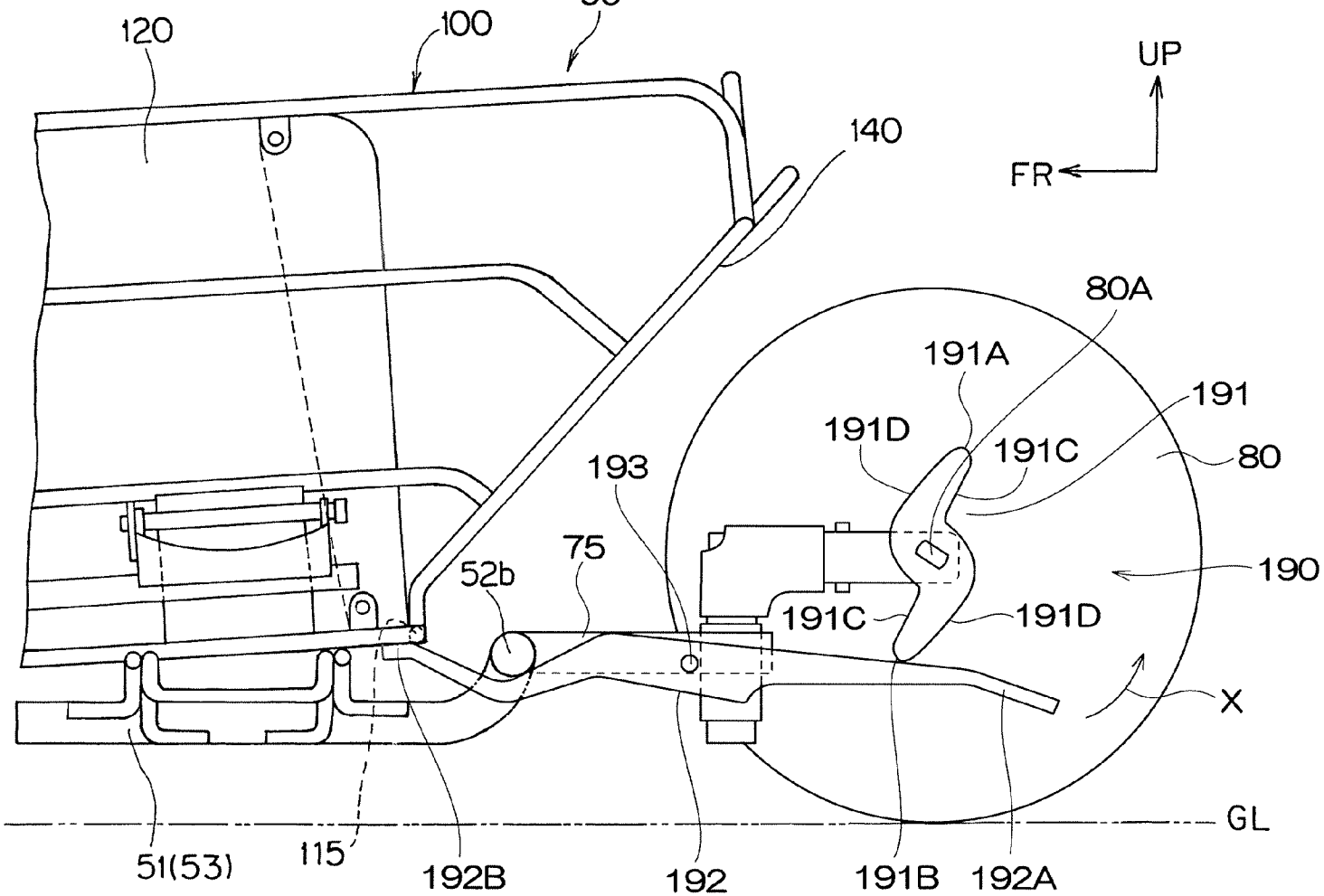
FIG. 13 is a diagram showing the other embodiment which corresponds to FIG. 9.

In this embodiment, a driving force conversion/transmission mechanism for vibrating the trash withdrawing member 100 vertically is different. As shown in FIG. 12 and FIG. 13, the driving force conversion/transmission mechanism 190 is configured so that the cam plate 191 is directly fixed to the axle 80*a* of the wheel 80, and the cam plate 191 has two cam protruding portions 191A and 191B and rotates in the direction of an arrow X together with the wheel 80. The cam plate 191 is configured so that the cam protruding portions 191A and 191B thereof serve as apexes, the rear edge portions 191C thereof are greatly constricted and the front edge portions 191D thereof are smoothly arcuate.

A cam lever 191 is brought into contact with the cam plate 191. The cam lever 192 is configured so that the center portion thereof is supported on the extension frame 75 through a supporting shaft 193 (see FIG. 11) so as to be freely swingable, one end 192A thereof is brought into contact with the lower surface portion of the cam plate 191 and the other end 192B thereof extends from the lower side of the rear lateral member 52*b* to the front portion of the second beach cleaner 50 and reaches the lower side of a lateral frame 115 (or sub frame 83) of the trash withdrawing member 100.

The cam lever 192 is configured so that the weight of the other end 192B side thereof is larger than the one end 192A side, and urged to be turned around the supporting shaft 193 in the rotational direction of the wheel 80, and the one end 192A comes into contact with the downward-facing surface portion of the cam plate 191 at all times.

Next, the operation will be described.

In FIG. 12, the other end 192B of the cam lever 192 is separated to the lower side of the lateral frame 115 of the trash withdrawing member 100. When the wheel 80 rotates in the direction of the arrow X, the cam plate 191 rotates in the same direction integrally with the wheel 80, and the one end 192A of the cam lever 192 is gradually pushed down according to the smooth cam profile of the front edge portion 191D.

Accordingly, as shown in FIG. 13, the cam lever 192 turns in the opposite direction to the wheel 80 around the supporting shaft 193, and the other end 192B of the cam lever 192 pushes up the lateral frame 115 (or the sub frame 83) of the trash withdrawing member 100.

When the cam protruding portion 191B of the cam plate 191 faces just downwardly, the other end 192B of the cam lever 192 pushes the lateral frame 115 of the trash withdrawing member 100 to the highest position.

When the wheel 80 further rotates, the cam protruding portion 191B of the cam plate 191 is separated from the one end 192A of the cam lever 192, and at this time the cam lever 192 loses the support of the cam plate 191 and thus it is drastically displaced from the position of FIG. 13 to the position of FIG. 12 because the rear edge portion 191C of the cam plate 191 has a greatly constricted shape. That is, the other end 192B of the cam lever 192 drastically drops bang, and thus the trash withdrawing member 100 drops to the substantially horizontal position.

According to this construction, the operation of pushing up the trash withdrawing member 100 and drastically dropping the trash withdrawing member 100 to the substantially horizontal position is repeated twice during one rotation of the wheel 80.

In the above embodiment, the driving force conversion/transmission mechanism 190 converts the driving force of the wheel 80 through the cam plate 191 and the cam lever 192 to driving force with which the trash withdrawing member 100 is vertically vibrated, and transmits the driving force concerned. Therefore, unlike the mechanism using the chain 93, the rotational driving force of the wheel can be remarkably efficiently converted to the vibration with a simple mechanism. The trash withdrawing member 100 drastically drops bang to the substantially horizontal position over twice every one-rotation of the wheel 80, and thus sand can be efficiently screened out by the impact at that time.

Figure 14:
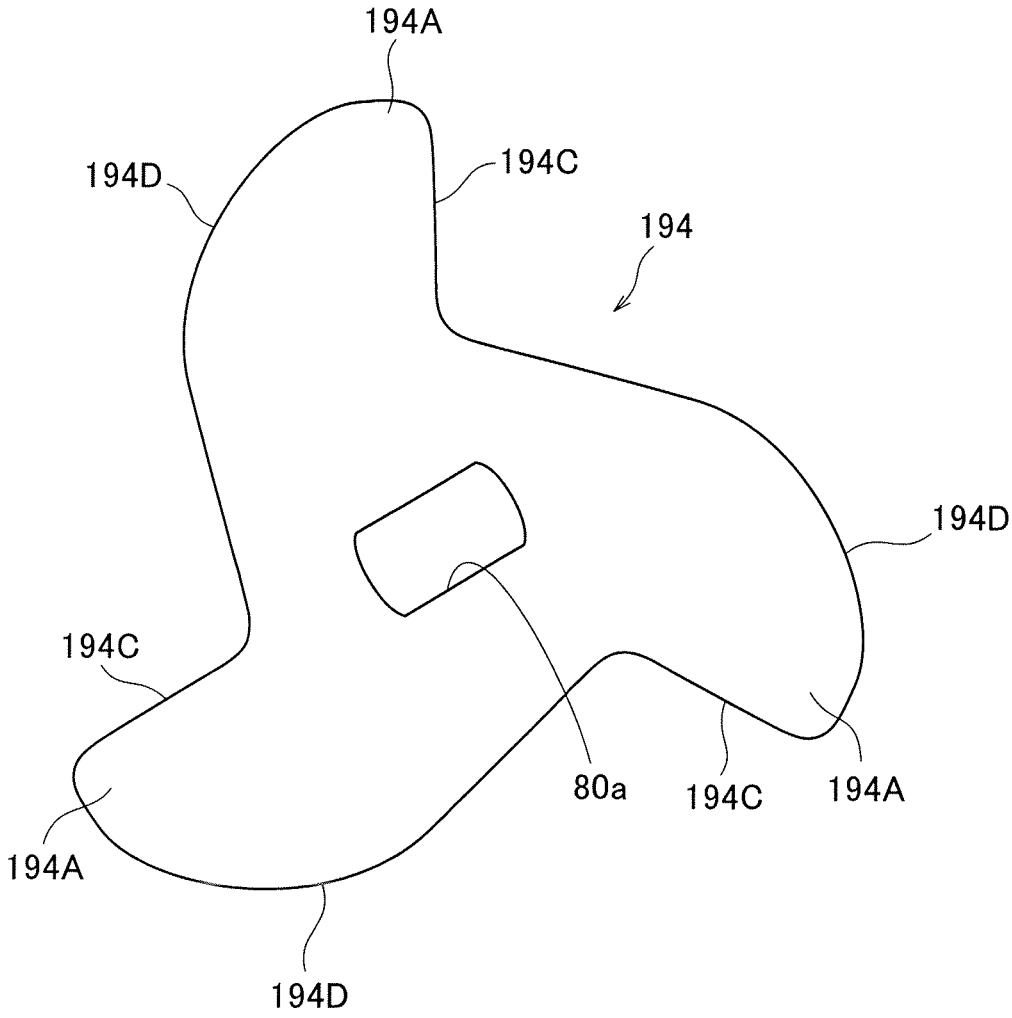
FIG. 14 is a diagram showing another embodiment of a cam plate.
Figure 16:
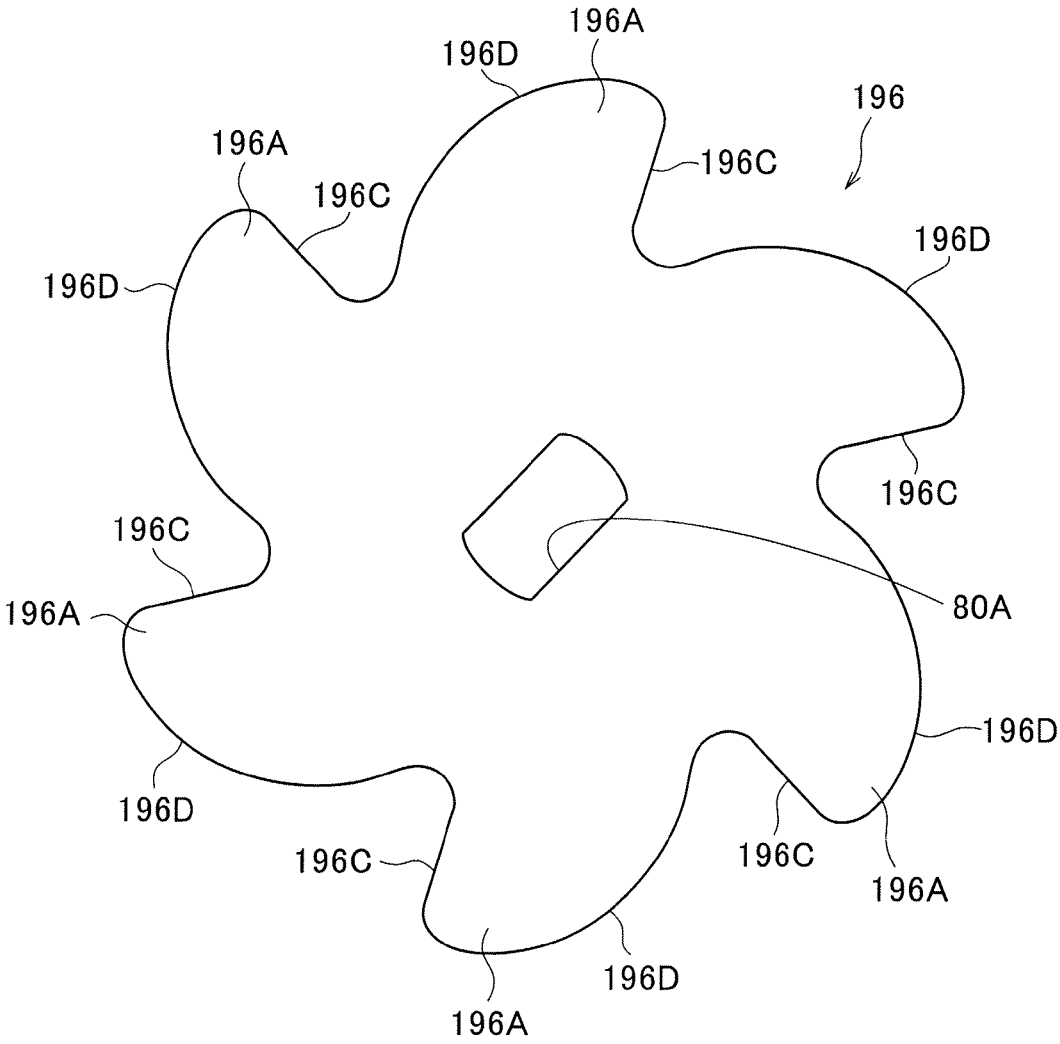
FIG. 16 is a diagram showing another embodiment of the cam plate.

FIG. 14 and FIG. 16 shows other embodiments of the cam plate.

Figure 15:
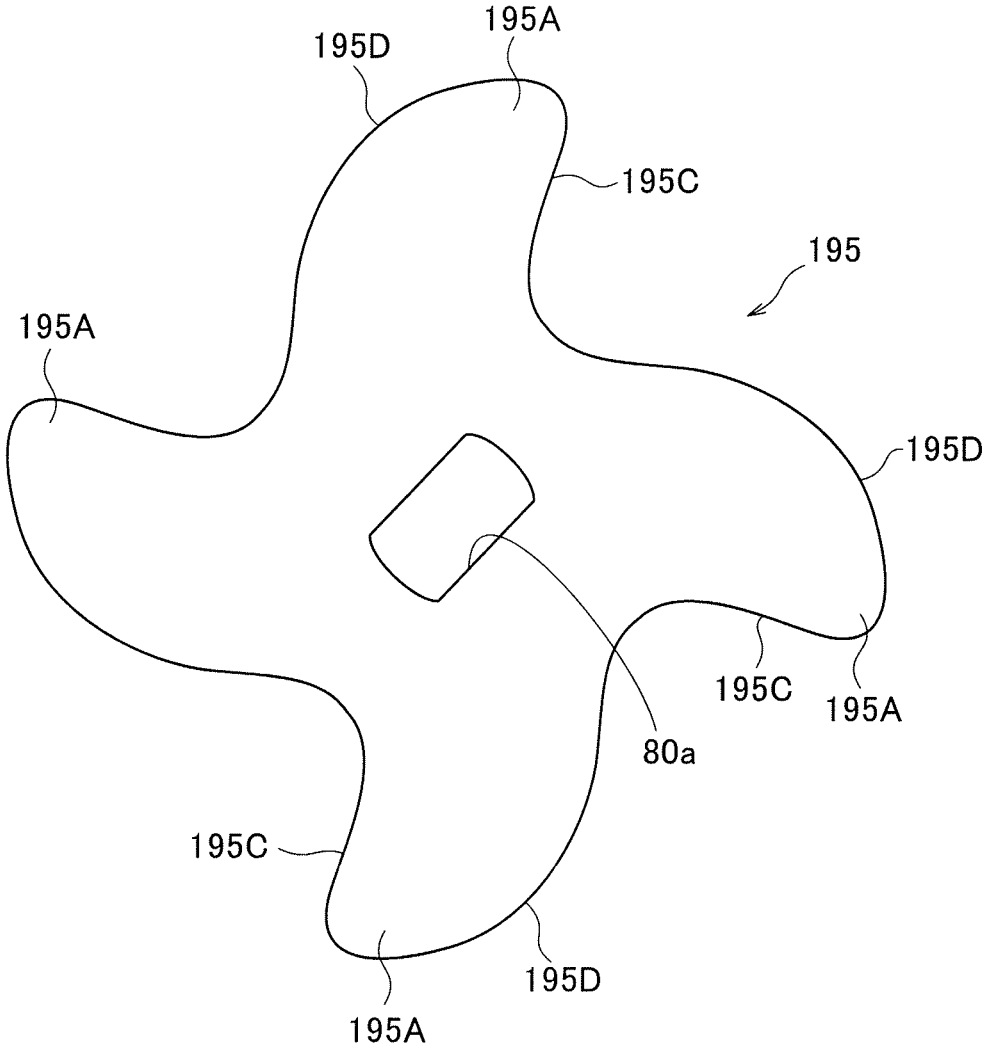
FIG. 15 is a diagram showing another embodiment of the cam plate.

A cam plate 194 shown in FIG. 14 has three cam protruding portions 194A, a cam plate 195 shown in FIG. 15 has four cam protruding portions 195A, and a cam plate 196 shown in FIG. 16 has six cam protruding portions 196A.

All the cam plates 194 to 196 have greatly constricted rear edge portions 194C to 196C, and front edge portions 194D to 196D having smooth arcuate shapes.

With respect to the cam plate 194 of FIG. 14, the trash withdrawing member 100 drastically drops bang three times during one rotation of the wheel 80. With respect to the cam plate 195 shown in FIG. 15, the trash withdrawing member 100 drastically drops four times, and with respect to the cam plate 196 shown in FIG. 15, the trash withdrawing member 100 drastically drops bang six times. When the dropping frequency is large, sand can be more efficiently screened out, however, the behavior of sand on the mesh member 116 is unstable. Accordingly, the cam plate is arbitrarily selected in accordance with the condition of the beach.

Figure 10:
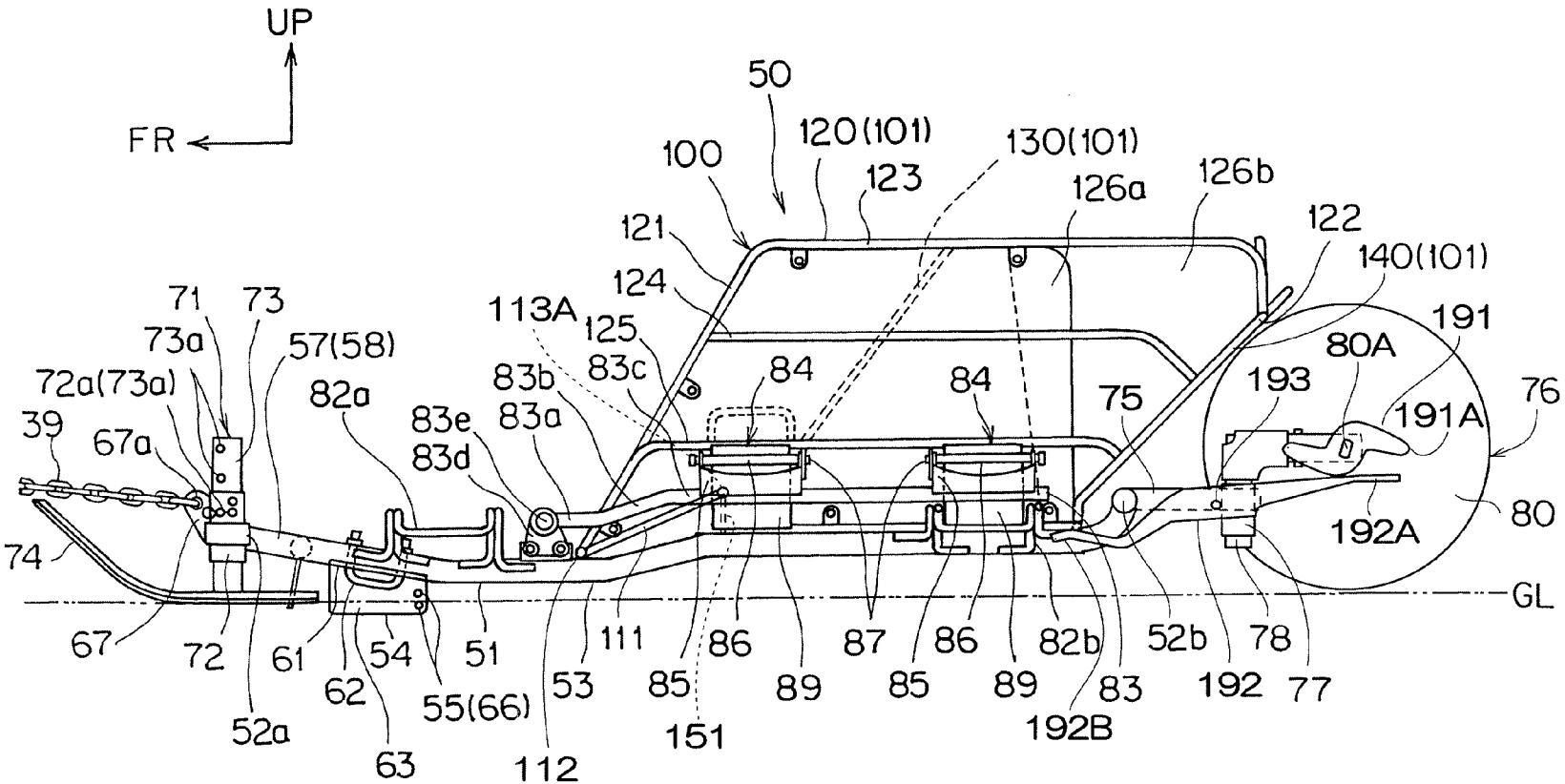
FIG. 10 is a diagram showing another embodiment which corresponds to FIG. 4.
Figure 11:
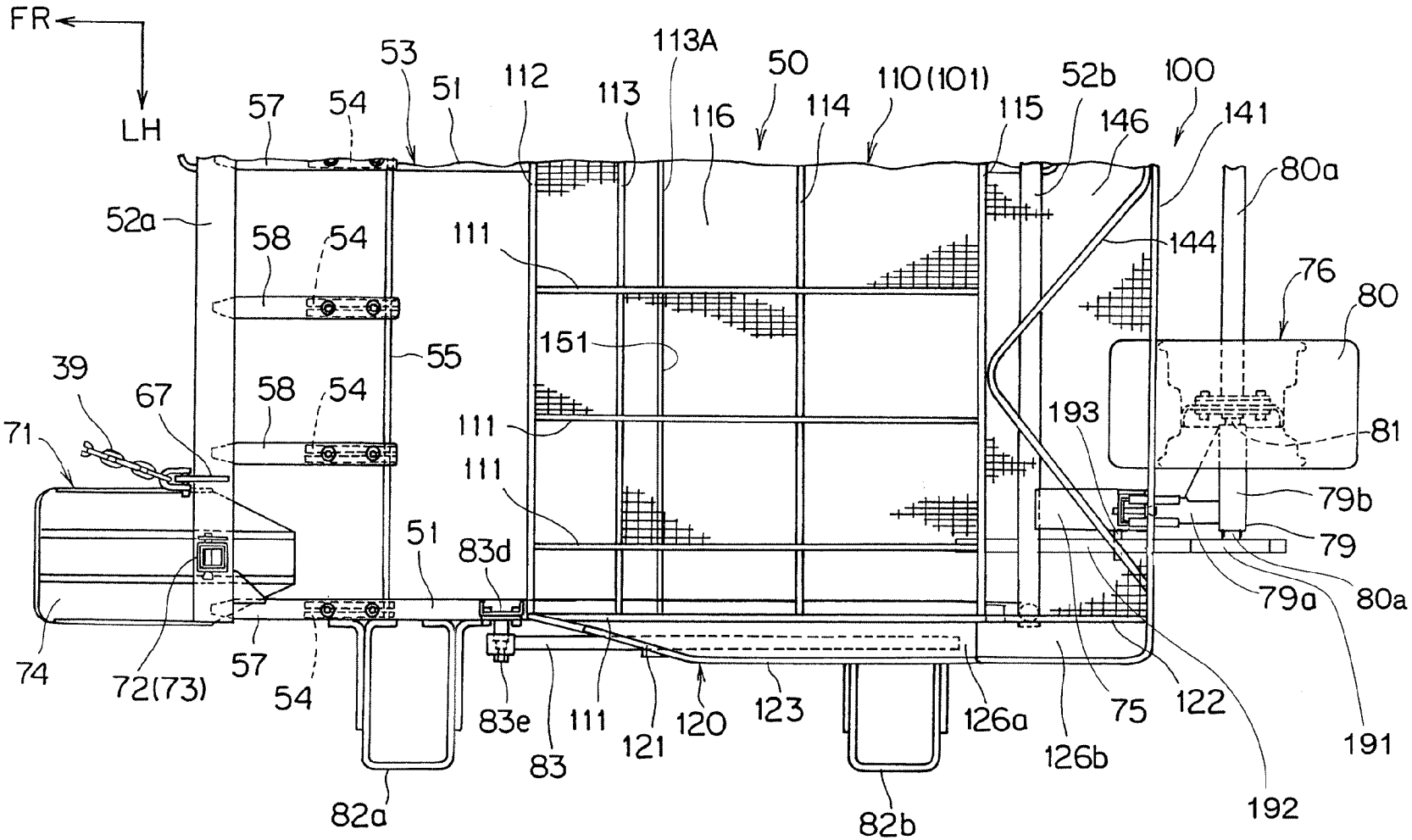
FIG. 11 is a diagram showing the other embodiment which corresponds to FIG. 5.

According to this embodiment, as shown in FIG. 10 and FIG. 11, the structure of the bottom wall portion 110 of the trash withdrawing member 100 is different.

The bottom wall portion 110 has plural (for example, nine) longitudinal frames 111 extending along the vehicle running direction, lateral frames 112, 113, 113A, 114 and 115 extending along the width direction (right-and-left direction) which is substantially perpendicular to the longitudinal frames 111, and a mesh member 116 such as a metal net or the like which are secured onto them.

The longitudinal frames 111 of the bottom wall portion 110 extend from the lateral frame 112 of the front end portion as a starting point so as to grow in height toward the lateral frame 113 and the lateral frame 113A in a substantially triangular shape, a front wall portion 151 which is higher by one step than the others and vertically hangs down with the lateral frame 113A as the apex in height is provided as shown in FIG. 10, and the longitudinal frames 111 further extend to the rear end portion substantially horizontally. The mesh member 116 such as the metal net or the like described above is secured on the longitudinal frames 111 along the shape of the longitudinal frames 111 in side view.

According to this construction, when the bottom wall portion 110 of the trash withdrawing member 100 is vertically vibrated, trash getting upon the mesh member 116 moves to the front end portion of the trash withdrawing member 100 in accordance with the vibration of the bottom wall portion 110. However, this trash is intercepted by the front wall portion 151 which is higher by one step in the substantially triangular shape, and thus it is prevented from dropping to the front end portion side of the trash withdrawing member 100.

DESCRIPTION OF REFERENCE NUMERALS

1 vehicle (towing vehicle)
50 second beach cleaner (beach cleaner)
51 longitudinal member
52*a* front lateral member
52*b* rear lateral member
53 frame
54 keel (separating machine)
55 scraper (separating machine)
56 trash withdrawing member
67 towed portion (portion to be towed)
74 front ski plate (ski member)
83 sub frame
83*e* turning shaft (front end)
84 hinge
88 mooring hook
90 driving force conversion/transmission mechanism
91 driving wheel
92 driven wheel
93 chain (driving force transmission mechanism) cam portion
95 arm portion
95*a* front arm (the other end)
95*b* rear arm (one end)
120 left side wall portion (side wall)
130 right side wall portion (side wall)
110 rear wall portion (bottom plate)
140 rear wall portion (rear wall)
GL ground surface (sand surface)

The invention claimed is:

1. A beach cleaner having a frame comprising longitudinal members and lateral members, a ski member that is secured to a front portion of the frame and comes into contact with the surface of a sand area, a towed portion to be towed by a towing vehicle, a separating machine that is provided to a front lower portion of the frame to separate and scrape up trash from the sand area, a trash withdrawing member that is provided at a rear side of the separating machine and captures, on a mesh member, the trash scraped up onto the frame at the rear side of the separating machine by the separating machine, and a wheel secured to a rear portion of the frame, characterized in that a pair of right and left sub frames are secured to right and left sides of the frame with a front end of the frame being used as a fulcrum so that a rear portion of the frame is swingable, the trash withdrawing member is secured to the pair of sub frames to support the trash withdrawing member so that the trash withdrawing member is swingable, and a driving force conversion/transmission mechanism for converting rotational driving force of the wheel to vibration force to vibrate the trash withdrawing member is provided.

2. The beach cleaner according to claim 1, wherein the trash withdrawing member is secured to the sub frame through a hinge at one side thereof in a right-and-left direction and through a detachable mooring hook at the other side thereof in the right-and-left direction, and the trash withdrawing member is rotated sideways with the hinge being used as a fulcrum.

3. The beach cleaner according to claim 1, wherein the trash withdrawing member has a side wall, a bottom wall and a rear wall, the bottom wall and the rear wall are designed in a mesh-like shape, and the rear wall is provided so as to slope backward.

4. The beach cleaner according to claim 3, wherein a one-step higher front wall portion is provided to a front end portion of the bottom wall.

5. The beach cleaner according to claim 1, wherein the driving force conversion/transmission mechanism comprises a driving wheel provided coaxially with the wheel, a driven wheel secured to the frame, a driving force transmission mechanism for transmitting driving force to the driving wheel to the driven wheel, a cam portion provided coaxially with the driven wheel, and an arm portion that is rotatably supported on the frame, brought into contact with the cam portion at one end thereof and brought into contact with the trash withdrawing member or the sub frame at the other end thereof.

6. The beach cleaner according to claim 1, wherein the driving force conversion/transmission mechanism has a cam plate that is provided rotatably integrally with an axle of the wheel, and a cam lever that is fitted to the cam plate at one end thereof, supported through a supporting shaft at the center thereof and brought into contact with the trash withdrawing member or the sub frame at the other end thereof.

* * * * *